US010281197B2

(12) United States Patent
Ammerman et al.

(10) Patent No.: US 10,281,197 B2
(45) Date of Patent: May 7, 2019

(54) QUICK SHELF ADJUSTMENT MECHANISM FOR A REFRIGERATING APPLIANCE

(71) Applicant: WHIRLPOOL CORPORATION, Benton Harbor, MI (US)

(72) Inventors: Jason Ammerman, Chicago, IL (US); Todd W. Lambkin, St. Joseph, MI (US); Yifan Wang, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/687,906

(22) Filed: Aug. 28, 2017

(65) Prior Publication Data

US 2018/0100687 A1 Apr. 12, 2018

Related U.S. Application Data

(60) Provisional application No. 62/406,567, filed on Oct. 11, 2016.

(51) Int. Cl.
*F25D 25/02* (2006.01)
*F25D 23/06* (2006.01)
(Continued)

(52) U.S. Cl.
CPC ..... *F25D 25/02* (2013.01); *A47B 96/07* (2013.01); *F25D 23/066* (2013.01);
(Continued)

(58) Field of Classification Search
CPC .. F25D 23/067; F25D 25/02; F25D 2325/021; F25D 23/066; A47B 57/06;
(Continued)

(56) References Cited

U.S. PATENT DOCUMENTS 774,117 A 11/1904 Tandy
1,952,148 A 3/1934 Stout
(Continued)

FOREIGN PATENT DOCUMENTS

CN 101611281 A 12/2009
CN 201779952 U 3/2011
(Continued)

OTHER PUBLICATIONS

GE Appliances, Refrigerator Capacity & Organization: Making Room for More, Jan. 17, 2014, http://www.geappliances.com/appliances/refrigerators/refrigerator-capacity-organize.htm.
(Continued)

*Primary Examiner* — Andrew M Roersma
(74) *Attorney, Agent, or Firm* — Price Heneveld LLP

(57) ABSTRACT

A shelf adjustment mechanism for an appliance includes a plurality of support surfaces coupled to a shelf bracket. The shelf bracket is operable between a securing position and a recessed position. A bracket module rotationally receives the shelf bracket. The securing position of the shelf bracket is defined by a substantially horizontal orientation of the support surfaces with respect to the bracket module. An angled biasing surface is defined on the shelf bracket. The biasing surface is configured to engage a shelf as the shelf is moved vertically along the angled biasing surface. Engagement of the shelf with the angled biasing surface selectively operates the shelf bracket from the securing position to a recessed position.

19 Claims, 27 Drawing Sheets

(51) Int. Cl.
*A47B 96/07* (2006.01)
*A47B 57/10* (2006.01)
*F25D 25/04* (2006.01)

(52) U.S. Cl.
CPC ..... *F25D 23/067* (2013.01); *A47B 57/10* (2013.01); *F25D 25/04* (2013.01); *F25D 2325/021* (2013.01)

(58) Field of Classification Search
CPC ..... A47B 57/08; A47B 57/10; A47B 57/12; A47B 57/14; A47B 96/07
See application file for complete search history.

(56) References Cited

U.S. PATENT DOCUMENTS 1,997,432 A 4/1935 Replogle
2,065,391 A 12/1936 Nance
2,187,916 A 1/1940 Seeger
2,225,762 A 12/1940 Barnsteiner
2,253,573 A * 8/1941 Nave ..... F25D 25/02 108/110
2,412,904 A 12/1946 Money et al.
2,434,117 A 1/1948 Money et al.
2,466,360 A 4/1949 Bitney
2,509,592 A 5/1950 Giffard
2,694,906 A 11/1954 Didion
2,710,993 A 6/1955 Kirkpatrick
2,742,559 A 4/1956 Edelman
2,773,677 A 12/1956 Hinkel
2,804,068 A 8/1957 Miller et al.
2,841,132 A 7/1958 Philipp
2,875,016 A 2/1959 Fry
2,967,625 A * 1/1961 Hoogenstyn ..... A47B 57/08 108/107
3,266,858 A 8/1966 Klotz
3,295,904 A 1/1967 Cobb
3,410,260 A 11/1968 Morgan
3,807,822 A * 4/1974 Amore ..... F25D 23/04 211/187
3,984,163 A 10/1976 Boorman, Jr. et al.
4,067,530 A * 1/1978 Overman ..... A47B 57/10 108/107
4,289,289 A * 9/1981 Overman ..... A47B 57/34 108/107
4,597,616 A 7/1986 Trubiano
4,729,613 A 3/1988 Tromble et al.
4,735,470 A 4/1988 Falk
5,088,801 A 2/1992 Rorke et al.
5,273,354 A 12/1993 Herrman et al.
5,411,165 A 5/1995 Ellis
5,415,472 A 5/1995 Brise
5,429,043 A 7/1995 Becker
5,447,146 A 9/1995 Nickerson
5,452,813 A * 9/1995 Grow ..... A47B 57/06 211/187
5,469,999 A 11/1995 Phirippidis
5,605,344 A 2/1997 Insalaco et al.
5,673,984 A 10/1997 Insalaco et al.
5,735,589 A 4/1998 Herrmann et al.
5,833,336 A 11/1998 Dean
5,947,573 A 9/1999 Tovar et al.
6,220,684 B1 4/2001 Bent et al.
6,578,720 B1 6/2003 Wang
D505,140 S 5/2005 Reed et al.
D516,100 S 2/2006 Vardon
D516,102 S 2/2006 Vardon
7,021,730 B2 4/2006 Remmers
D523,034 S 6/2006 Vardon
7,059,693 B2 6/2006 Park
D525,633 S 7/2006 Vardon
7,070,249 B2 7/2006 Leimkuehler et al.
7,131,545 B1 11/2006 Grogan
7,178,890 B2 2/2007 Park et al.
7,188,738 B2 3/2007 Stafford et al.
D547,640 S 7/2007 Remmers
D551,262 S 9/2007 Becke
D551,884 S 10/2007 Remmers
7,367,571 B1 5/2008 Nichols
7,467,834 B2 12/2008 Kim et al.
7,497,533 B2 3/2009 Remmers
7,552,983 B2 6/2009 Shin
7,669,945 B2 * 3/2010 Blersch ..... F25D 23/067 108/107
7,726,753 B2 6/2010 Bassi
7,748,569 B2 7/2010 Sunatori
7,878,344 B2 2/2011 Martin et al.
7,976,113 B2 7/2011 Gwak
8,047,397 B2 11/2011 Mittet
D656,970 S 4/2012 Merritt
8,172,347 B2 5/2012 Lim et al.
8,182,056 B2 5/2012 Gossens et al.
8,240,512 B2 8/2012 Sunatori
D669,506 S 10/2012 Czach et al.
8,297,726 B2 10/2012 Ramm et al.
8,345,326 B2 1/2013 Kitagaki et al.
8,381,949 B2 2/2013 Sunatori
8,403,438 B2 3/2013 Park et al.
8,444,239 B2 5/2013 Gossens et al.
D692,034 S 10/2013 Seo et al.
8,562,089 B2 10/2013 Collins et al.
D694,288 S 11/2013 Hottmann et al.
D694,289 S 11/2013 Hottmann et al.
D694,292 S 11/2013 Eby et al.
8,726,689 B2 5/2014 Jang et al.
8,733,862 B1 5/2014 Armstrong et al.
D707,267 S 6/2014 Choi et al.
8,739,568 B2 6/2014 Allard et al.
D709,927 S 7/2014 Park et al.
8,777,341 B2 7/2014 Amaral et al.
D710,405 S 8/2014 Seo et al.
D711,943 S 8/2014 Park et al.
D714,840 S 10/2014 Yang et al.
D717,349 S 11/2014 Seo et al.
D719,986 S 12/2014 Kim et al.
8,960,826 B2 2/2015 Choo et al.
D734,784 S 7/2015 Kim et al.
9,103,582 B2 8/2015 Nash et al.
9,131,785 B2 9/2015 Peru
9,151,534 B2 10/2015 Lee et al.
D745,581 S 12/2015 Jeon et al.
D747,369 S 1/2016 McConnell et al.
D747,370 S 1/2016 Kim et al.
D747,371 S 1/2016 Lee et al.
D747,372 S 1/2016 Kim et al.
D747,373 S 1/2016 Lee et al.
D748,165 S 1/2016 McConnell et al.
9,297,573 B2 3/2016 Krause et al.
D754,759 S 4/2016 McConnell et al.
9,320,368 B2 4/2016 Marotti et al.
D761,884 S 7/2016 Austin et al.
9,510,679 B2 12/2016 Bhatt et al.
9,671,115 B2 6/2017 Elkasevic
9,823,013 B1 11/2017 Caglin et al.
9,861,200 B2 1/2018 Lim
9,945,601 B1 4/2018 Bhavsar et al.
2003/0020387 A1 1/2003 Wing et al.
2004/0104323 A1 6/2004 Hubert et al.
2005/0073225 A1 4/2005 Kwon et al.
2006/0042305 A1 3/2006 Oh et al.
2006/0049731 A1 3/2006 Choi et al.
2006/0226749 A1 10/2006 Kim
2006/0226751 A1 10/2006 Park
2008/0203041 A1 8/2008 Lim et al.
2008/0315743 A1 12/2008 Oh
2009/0193836 A1 8/2009 Ertz et al.
2010/0102693 A1 4/2010 Driver et al.
2010/0219731 A1 9/2010 Candeo et al.
2011/0001415 A1 1/2011 Park et al.
2011/0072846 A1 3/2011 Engel et al.
2011/0115356 A1 5/2011 Nash et al.
2012/0018434 A1 1/2012 Gwak
2012/0024006 A1 2/2012 Knoll et al.
2012/0091084 A1 4/2012 Amaral et al.

(56) References Cited

U.S. PATENT DOCUMENTS

| | | | |
|---|---|---|---|
| 2012/0223038 | A1 | 9/2012 | Bean |
| 2012/0248958 | A1 | 10/2012 | Ertz et al. |
| 2013/0020922 | A1 | 1/2013 | Jang |
| 2013/0219731 | A1 | 8/2013 | Zhang |
| 2014/0217044 | A1 | 8/2014 | Cole |
| 2015/0068999 | A1 | 3/2015 | Dart et al. |
| 2015/0107084 | A1 | 4/2015 | Craycraft et al. |
| 2015/0351532 | A1 | 12/2015 | Peru |
| 2016/0067863 | A1 | 3/2016 | Cole |
| 2017/0086580 | A1 | 3/2017 | Conti |
| 2017/0181538 | A1 | 6/2017 | Azkue et al. |
| 2017/0276425 | A1 | 9/2017 | Fink et al. |
| 2017/0341217 | A1 | 11/2017 | Cole |
| 2018/0127007 | A1 | 5/2018 | Kravchenko |

FOREIGN PATENT DOCUMENTS

| | | | | |
|---|---|---|---|---|
| CN | 102135363 | A | 7/2011 | |
| CN | 102395849 | A | 3/2012 | |
| CN | 102494496 | A | 6/2012 | |
| CN | 102829604 | A | 12/2012 | |
| CN | 102889744 | A | 1/2013 | |
| CN | 101688748 | B | 12/2013 | |
| CN | 104089457 | A | 10/2014 | |
| CN | 205619680 | U | 10/2016 | |
| CN | 205641793 | U | 10/2016 | |
| CN | 205980510 | U | 2/2017 | |
| DE | 700820 | T1 | 11/1996 | |
| DE | 29813899 | U1 * | 12/1999 | ..... A47B 57/10 |
| DE | 69519613 | T2 | 4/2001 | |
| DE | 10107646 | A1 | 8/2002 | |
| DE | 69529852 | T2 | 9/2003 | |
| DE | 102012223131 | A1 | 6/2014 | |
| EP | 0577939 | A1 | 1/1994 | |
| EP | 700820 | A2 | 3/1996 | |
| EP | 579364 | B1 | 12/1997 | |
| EP | 940316 | A2 | 9/1999 | |
| EP | 1349802 | B1 | 8/2008 | |
| EP | 1985205 | A1 | 10/2008 | |
| EP | 2424421 | B1 | 10/2015 | |
| EP | 2926069 | | 10/2015 | |
| EP | 2760315 | B1 | 8/2016 | |
| EP | 3327390 | A1 | 5/2018 | |
| ES | 2327831 | T3 | 11/2009 | |
| IN | 201737009466 | | 8/2017 | |
| JP | 2002090054 | A | 3/2002 | |
| KR | 100364994 | B1 | 12/2002 | |
| KR | 374557 | B1 | 3/2003 | |
| KR | 20030061668 | A | 7/2003 | |
| KR | 100431346 | B1 | 5/2004 | |
| KR | 1020040070986 | | 8/2004 | |
| KR | 100559722 | B1 | 3/2006 | |
| KR | 100756887 | B1 | 9/2007 | |
| KR | 850005 | B1 | 8/2008 | |
| KR | 2010026614 | A | 3/2010 | |
| KR | 20140022598 | A | 2/2014 | |
| KR | 2017043815 | A | 4/2017 | |
| WO | 02014761 | A1 | 2/2002 | |
| WO | 2005012812 | A1 | 2/2005 | |
| WO | 2008015180 | A2 | 2/2008 | |
| WO | 2009155679 | A2 | 12/2009 | |
| WO | 2011009773 | | 1/2011 | |
| WO | 2011080109 | A2 | 7/2011 | |
| WO | 2012062670 | A2 | 5/2012 | |
| WO | 2015101430 | A1 | 7/2015 | |
| WO | 2015101434 | A1 | 7/2015 | |
| WO | 2015149832 | A1 | 10/2015 | |
| WO | 2015165531 | A1 | 11/2015 | |
| WO | 2016155784 | A1 | 10/2016 | |
| WO | 2017005314 | A1 | 1/2017 | |

OTHER PUBLICATIONS

GE Appliances, GE Profile Side by Side Refrigerators, Jan. 17, 2014, http://www.abt.com/ge/GE_Profile_SideBySide.

* cited by examiner

QUICK SHELF ADJUSTMENT MECHANISM FOR A REFRIGERATING APPLIANCE

CROSS-REFERENCE TO RELATED APPLICATION

This application claims priority to and the benefit under 35 U.S.C. § 119(e) of U.S. Provisional Patent Application No. 62/406,567, filed on Oct. 11, 2016, entitled "QUICK SHELF ADJUSTMENT MECHANISM FOR A REFRIGERATING APPLIANCE," the entire disclosure of which is hereby incorporated herein by reference.

FIELD OF THE DEVICE

The device is in the field of refrigerating appliances, and more specifically, adjustable shelving supports disposed within refrigerating appliances.

SUMMARY

In at least one aspect, a shelf adjustment mechanism for an appliance includes a plurality of support surfaces coupled to a shelf bracket. The shelf bracket is operable between a securing position and a recessed position. A bracket module rotationally receives the shelf bracket. The securing position of the shelf bracket is defined by a substantially horizontal orientation of the support surfaces with respect to the bracket module. An angled biasing surface is defined on the shelf bracket. The biasing surface is configured to engage a shelf as the shelf is moved vertically along the angled biasing surface. Engagement of the shelf with the angled biasing surface selectively operates the shelf bracket from the securing position to a recessed position.

In at least another aspect, an appliance includes a structural cabinet having an inner liner that defines a refrigerating compartment. A shelf is selectively disposed in a plurality of vertical positions within the refrigerating compartment. A shelf adjustment mechanism is coupled to the inner liner and defining the plurality of vertical positions of the shelf. The shelf adjustment mechanism includes opposing shelf brackets that are rotationally biased toward a securing position that is configured to alternatively and selectively support the shelf in one of a lower shelf position and an upper shelf position of the plurality of vertical positions. Operation of the opposing shelf brackets from the securing position to a recessed position defines a clearance space that provides for vertical movement of the shelf within the refrigerating compartment while a top surface of the shelf is maintained in a horizontal position. Operation of the opposing shelf brackets from the securing position to the recessed position is performed by the upward vertical movement of the shelf.

In at least another aspect, a shelf adjustment mechanism for an appliance includes opposing shelf brackets coupled to an inner liner. The opposing shelf brackets cooperate to define upper and lower support surfaces, wherein each shelf bracket of the opposing shelf brackets are biased toward a securing position where the upper and lower support surfaces are configured to be in a horizontal orientation relative to the inner liner. Opposing bracket modules hingedly support the opposing shelf brackets, respectively, wherein each shelf bracket is configured to selectively rotate within a respective bracket module of the opposing bracket modules between the securing position and a recessed position. A shelf is configured to selectively and alternatively rest on one of the upper and lower support surfaces in the securing position. The shelf is received on the lower support surface.

Slidable operation of the shelf in an upward direction biases the opposing shelf brackets to the recessed position. The recessed position defines a clearance space that provides for vertical movement of the shelf over the opposing shelf brackets. When the shelf is slidably operated upward and above the opposing shelf brackets in the recessed position, the opposing shelf brackets are biased back to the securing position to define at least the upper support surface.

These and other features, advantages, and objects of the present device will be further understood and appreciated by those skilled in the art upon studying the following specification, claims, and appended drawings.

DETAILED DESCRIPTION OF EMBODIMENTS

Figure 1:
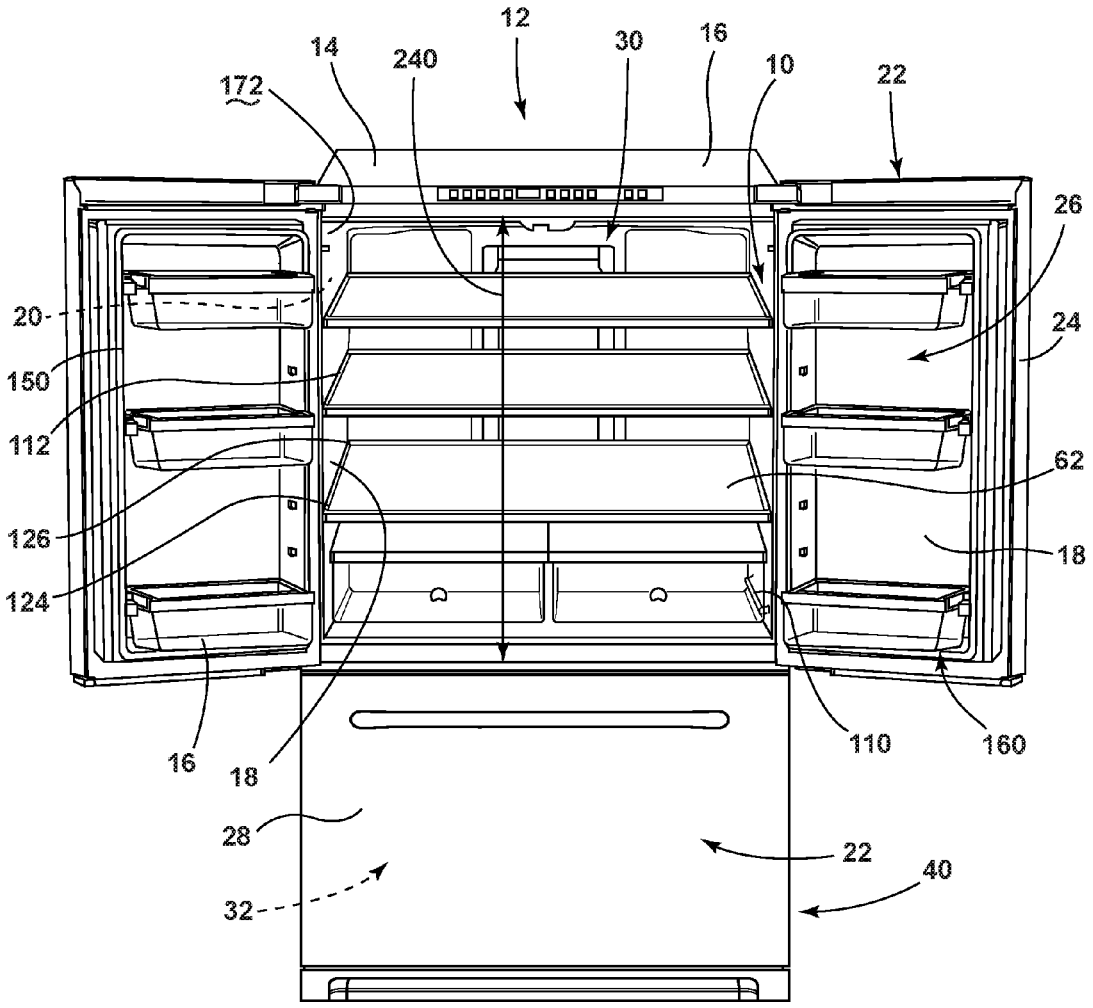
FIG. 1 is a front perspective view of an appliance incorporating an aspect of the shelf adjustment mechanism for supporting shelves and/or door bins within the refrigerating appliance.
Figure 2:
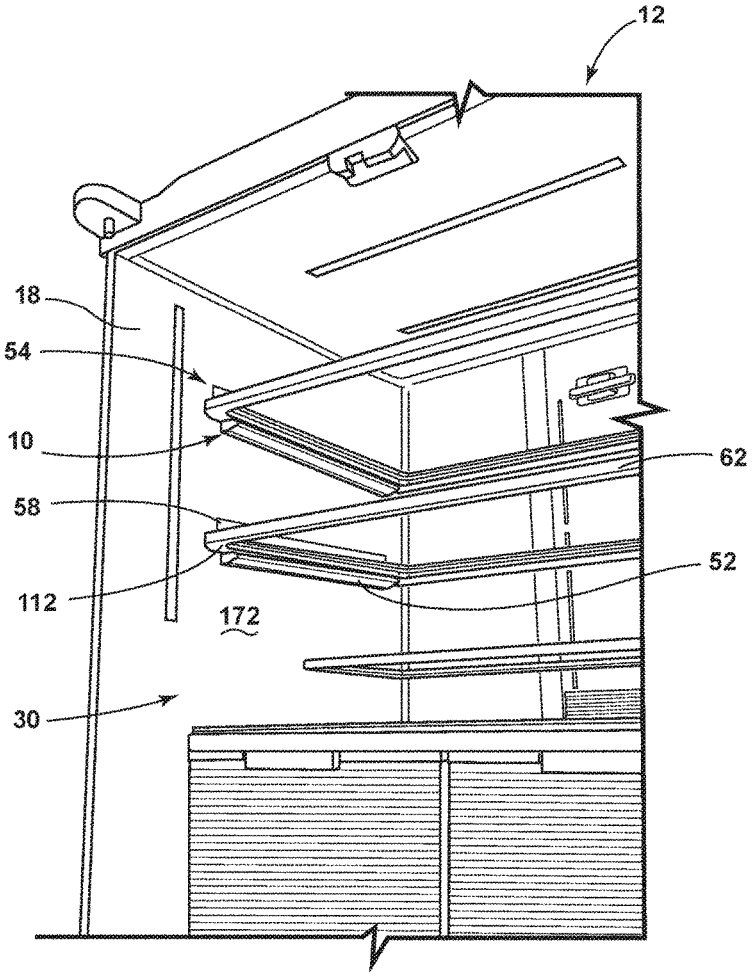
FIG. 2 is a perspective view of a refrigerating compartment of an appliance incorporating an aspect of the shelf adjustment mechanism.
Figure 3:
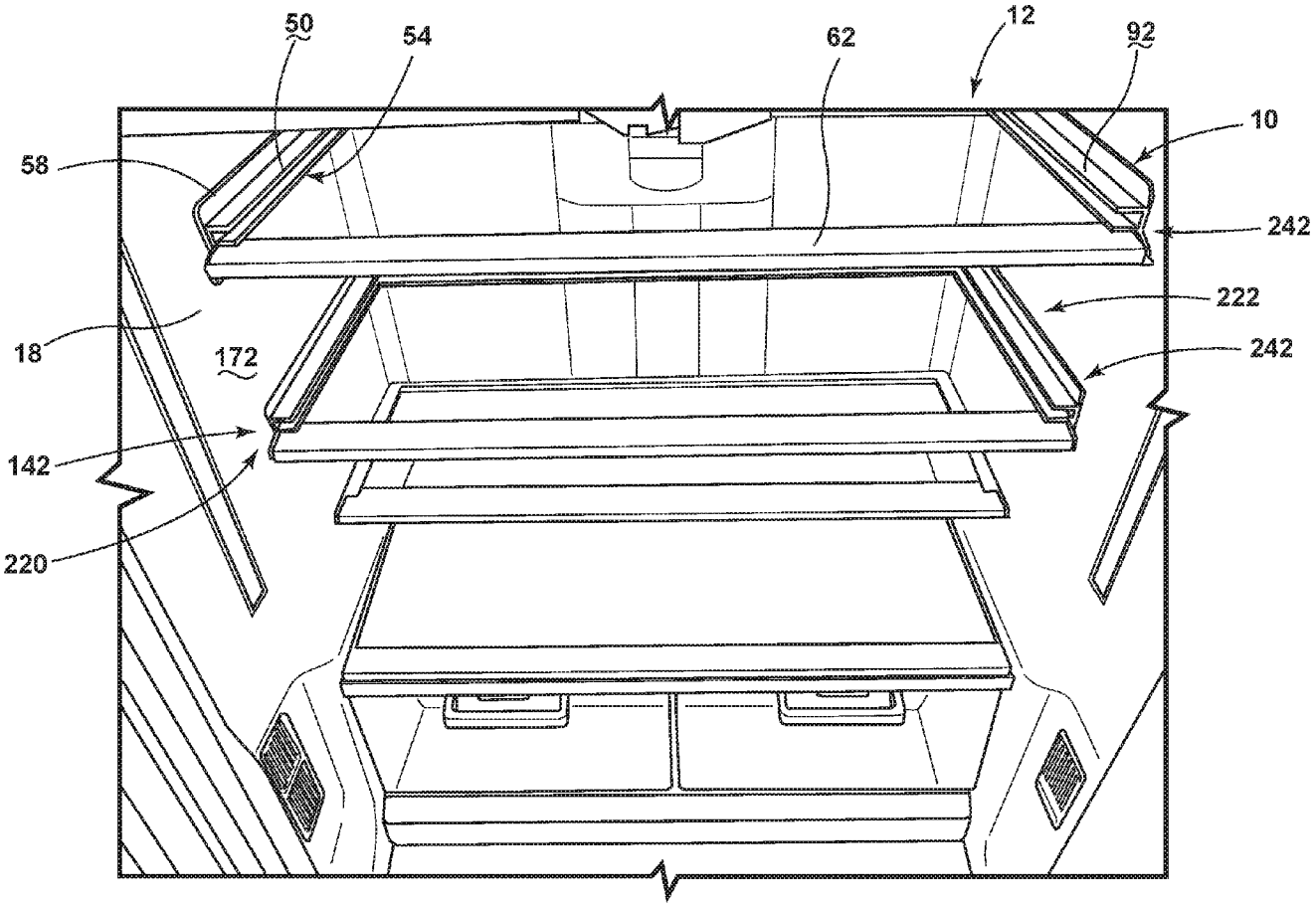
FIG. 3 is a top perspective view of the refrigerating compartment of FIG. 2.
Figure 4:
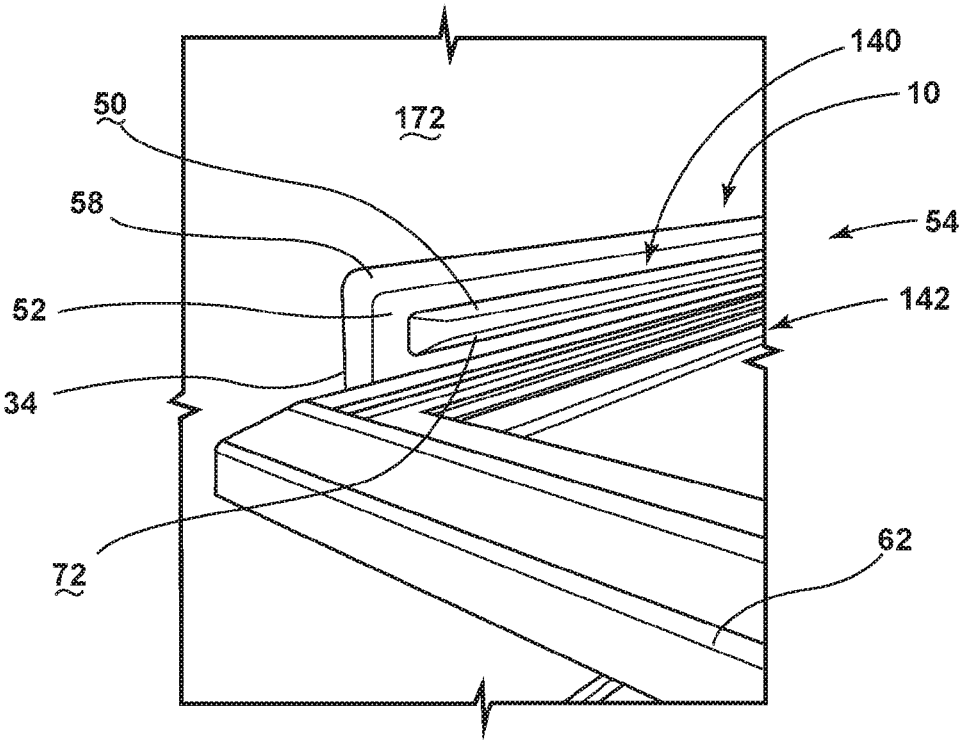
FIG. 4 is a side perspective view of an aspect of the shelf adjustment mechanism supporting a shelf on a lower support surface.
Figure 5:
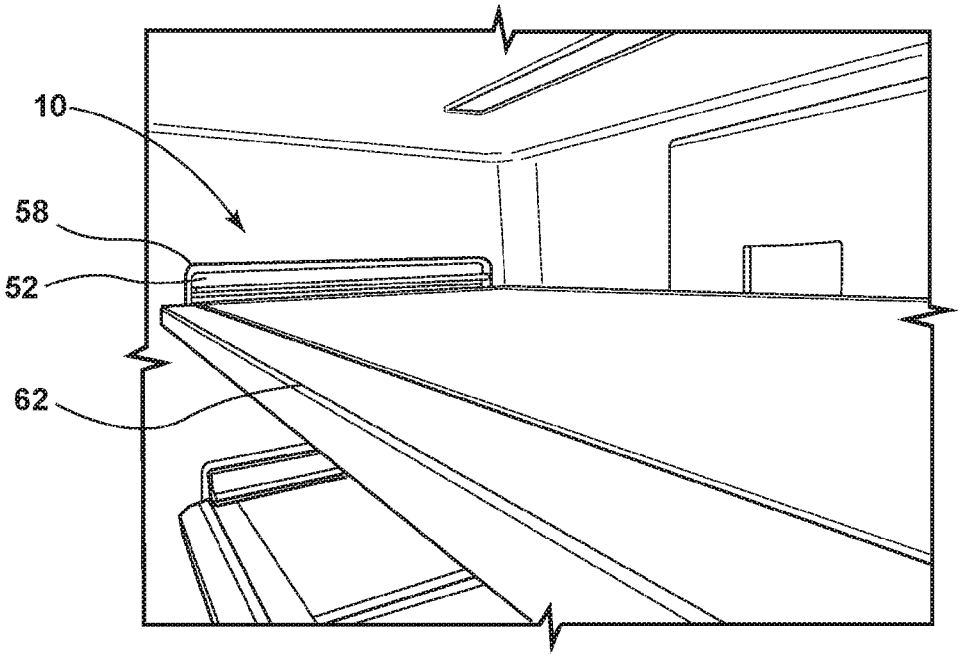
FIG. 5 is a side perspective view of an aspect of the shelf adjustment mechanism supporting a shelf on a lower support surface.
Figure 6:
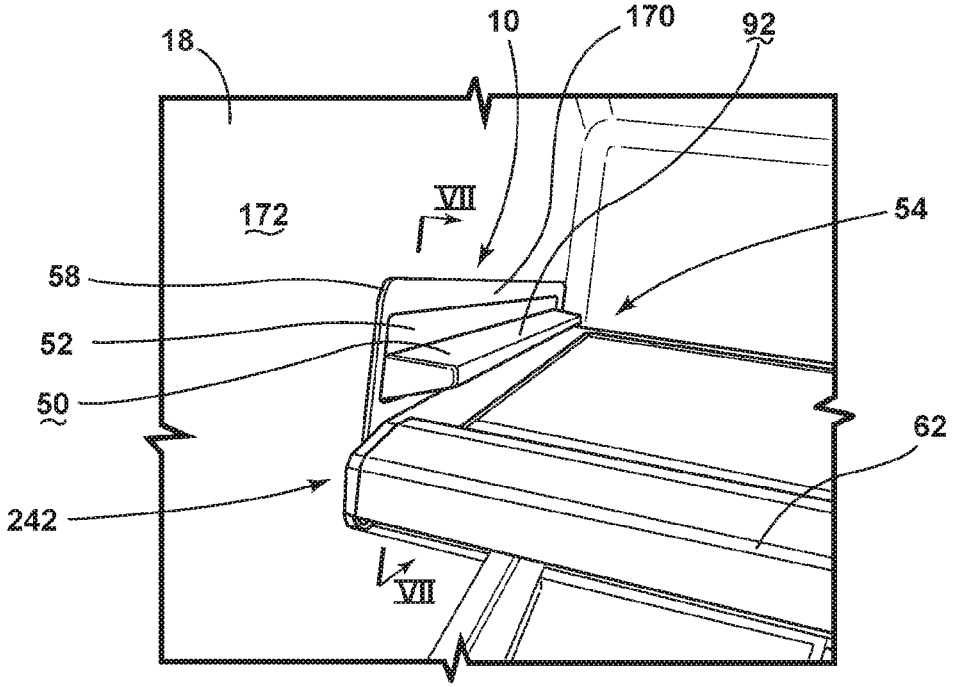
FIG. 6 is a front perspective view of the shelf adjustment mechanism of FIG. 4.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As illustrated in FIGS. 1-8, a shelf adjustment mechanism 10 is incorporated within a refrigerating appliance 12, where the refrigerating appliance 12 includes a structural cabinet 14 formed by an outer wrapper 16 and an inner liner 18 that are connected to define an insulating cavity 20 therebetween. Various operable panels 22 are coupled to the structural cabinet 14 and include a rotationally operable hinged door 24 that defines an interior storage space 26 within a portion of the hinged door 24. The operable panels 22 can also include an operable drawer panel 40 that includes an interior storage space 26 defined by the inner liner 18 of the operable drawer 28. According to the various embodiments, certain fixtures can be recessed within the inner liner 18 for maximizing storage space within an interior compartment of the appliance 12, such as a refrigerating compartment 30, pantry compartment, freezing compartment 32 and other similar interior compartments. These fixtures can be disposed within liner recesses 34 of the inner liner 18 without substantially interfering with the insulating capability and utility paths for serving the appliance 12.

Referring again to FIGS. 1-8, the appliance 12 can include a shelf adjustment mechanism 10, where the shelf adjustment mechanism 10 includes a plurality of support surfaces 50 that are coupled to at least one shelf bracket 52. The various shelf brackets 52 are configured to be operable between a securing position 54 and a recessed position 56. A bracket module 58 includes a bracket cavity 60 that rotationally receives at least one shelf bracket 52. Each bracket module 58 can include multiple shelf brackets 52 as well. It is contemplated that the bracket module 58 is adapted to be inserted within a liner recess 34 defined within the inner liner 18 of the appliance 12. It is also contemplated that the securing position 54 of the shelf bracket 52 is defined by a substantially horizontal position of the support surface 50 of the shelf bracket 52 with respect to the bracket module 58. Accordingly, the securing position 54 of the shelf bracket 52 serves to define a supporting surface for a shelf 62 placed thereon.

According to the various embodiments, a particular bracket module 58 may include a plurality of support surfaces 50, such that the shelf bracket 52 can be operated between the securing and recessed positions 54, 56 to allow for vertical movement 70 of the shelf 62 between the various support surfaces 50 of the shelf adjustment mechanism 10.

In order to provide for the movement of the shelf bracket 52 between the securing and recessed positions 54, 56, one or more angled biasing surfaces 72 can be defined on one or more of the shelf brackets 52. It is contemplated that the shelf 62 during vertical movement 70 is adapted to engage the angled biasing surface 72 as the shelf 62 is moved vertically along the angled biasing surface 72. Engagement of the shelf 62 with one of the angled biasing surfaces 72 serves to operate the corresponding shelf bracket 52 from the securing position 54 to the recessed position 56. Typically, each support surface 50 will include a corresponding angled biasing surface 72.

Figure 7:
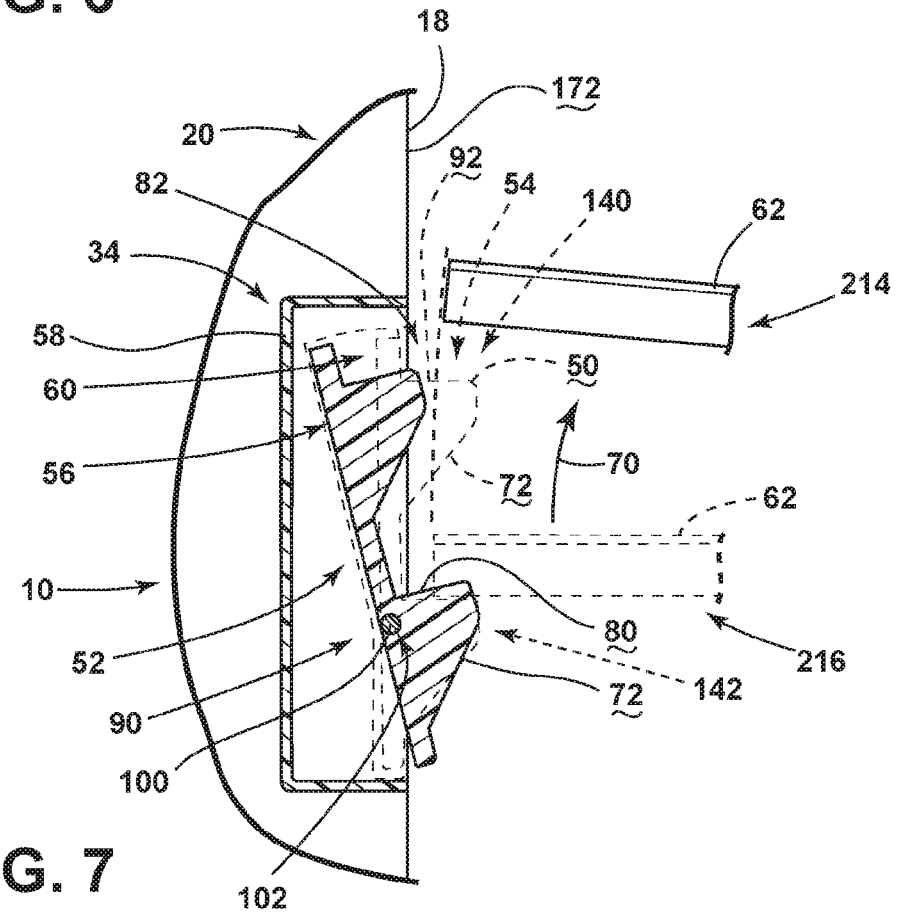
FIG. 7 is a schematic cross-sectional view of the shelf adjustment mechanism of FIG. 6 taken along line VII-VII and exemplifying the securing and recessed positions of the shelf bracket.
Figure 8:
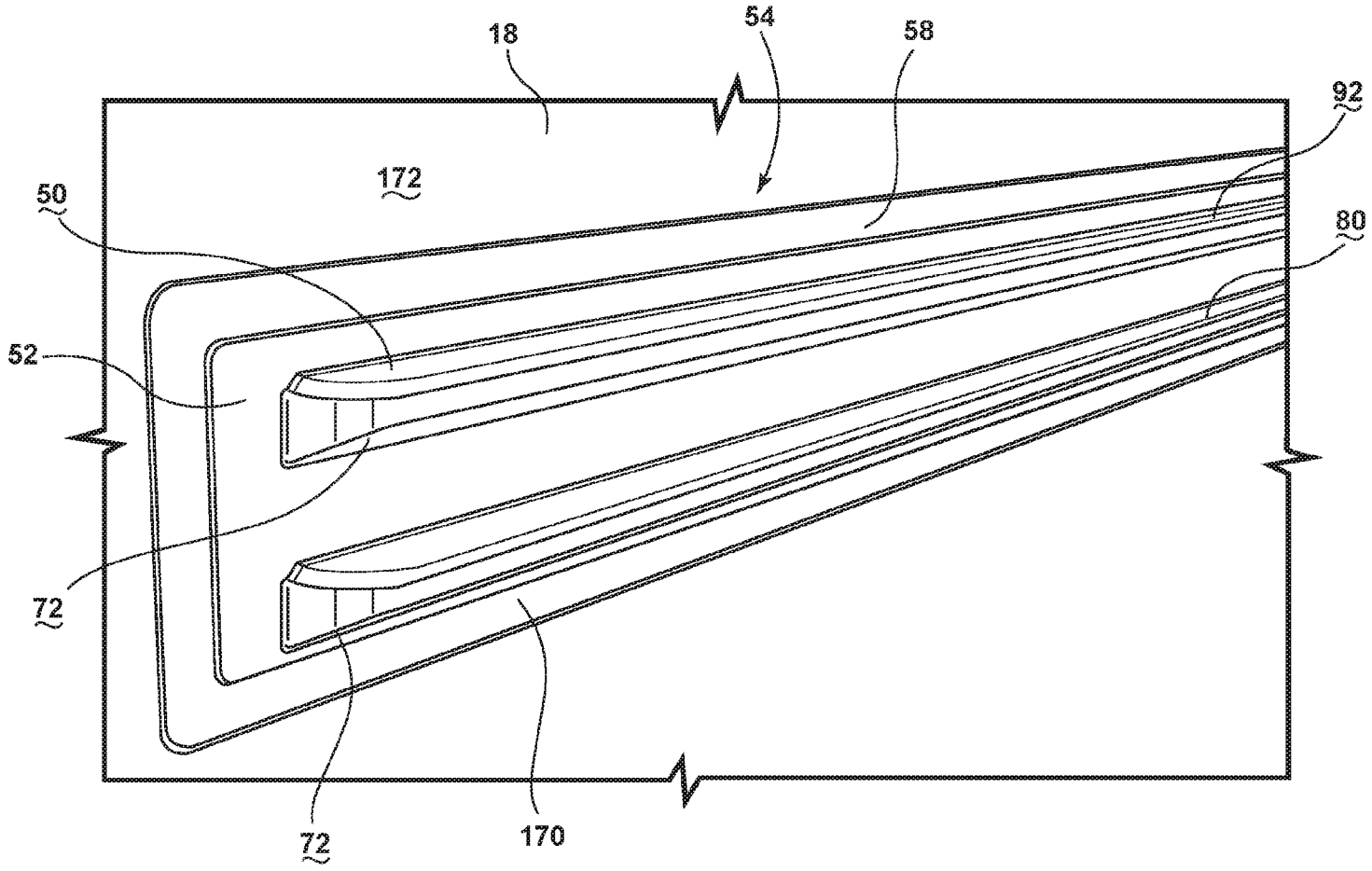
FIG. 8 is a top perspective view of the shelf adjustment mechanism of FIG. 4 with the shelf removed.
Figure 9:
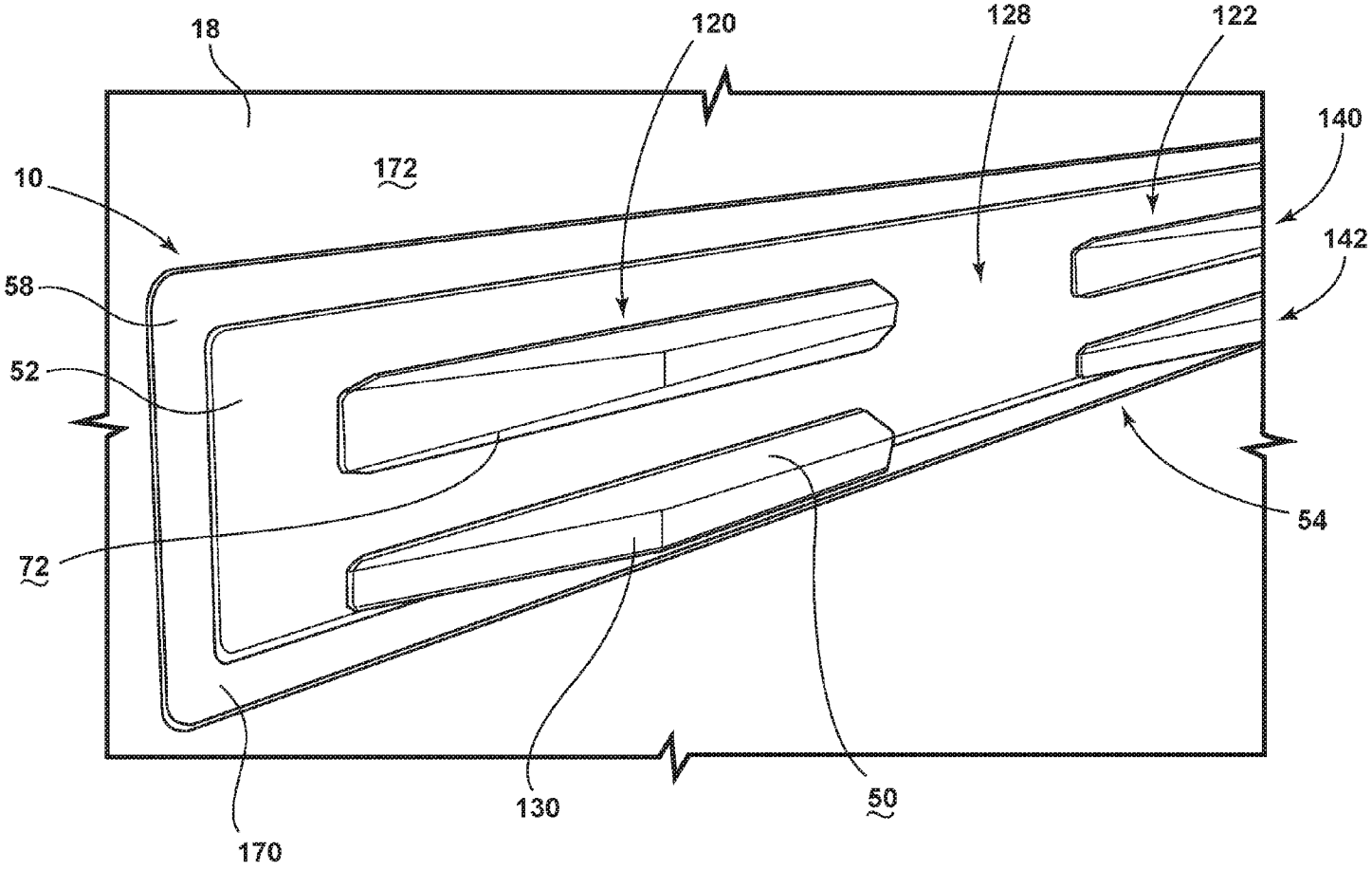
FIG. 9 is a side perspective view of an aspect of the shelf adjustment mechanism having front and rear supports and shown with a shelf removed.
Figure 10:
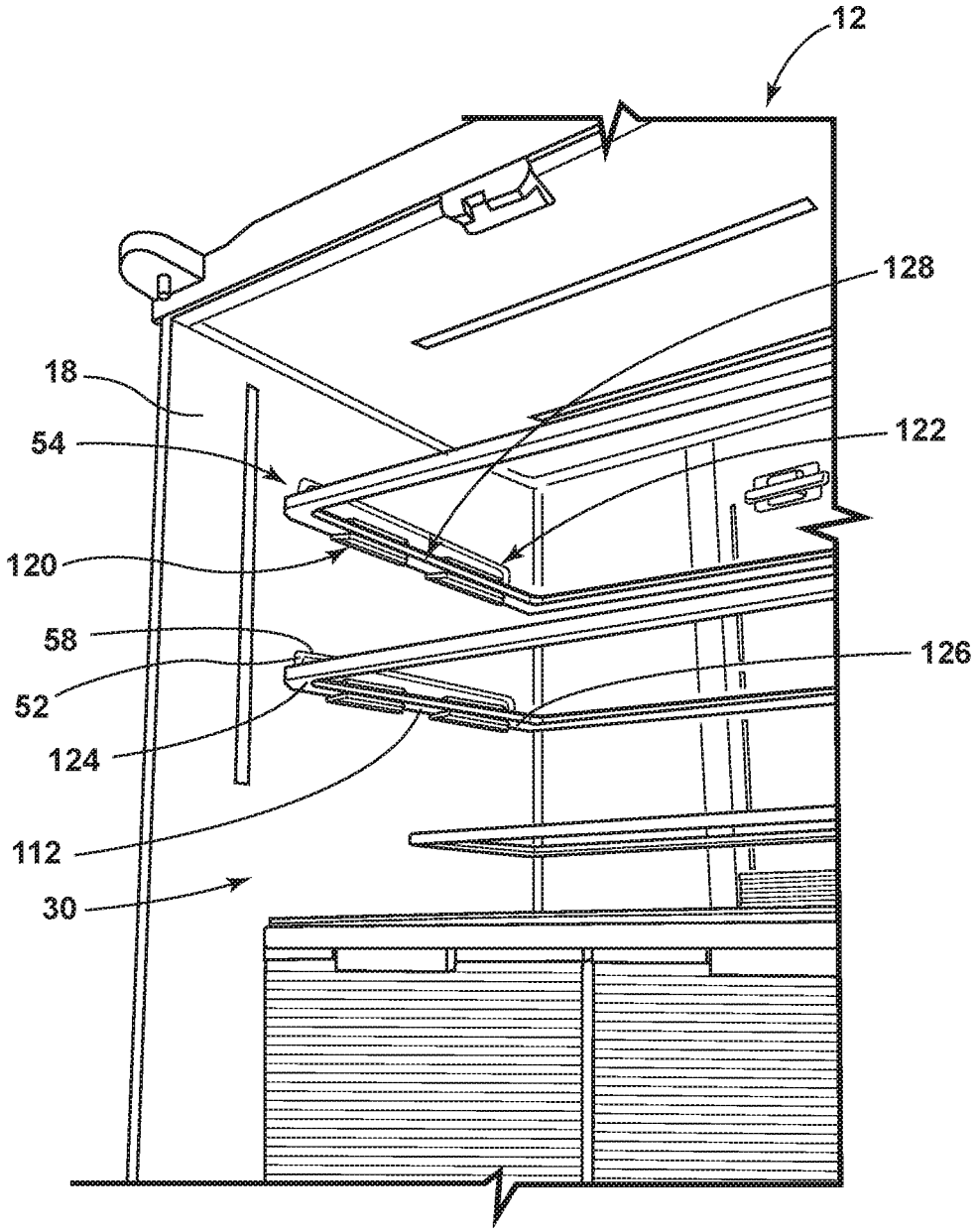
FIG. 10 is a bottom perspective view of a refrigerating compartment for an appliance incorporating the shelf adjustment mechanism of FIG. 9 and shown with shelves installed.
Figure 11:
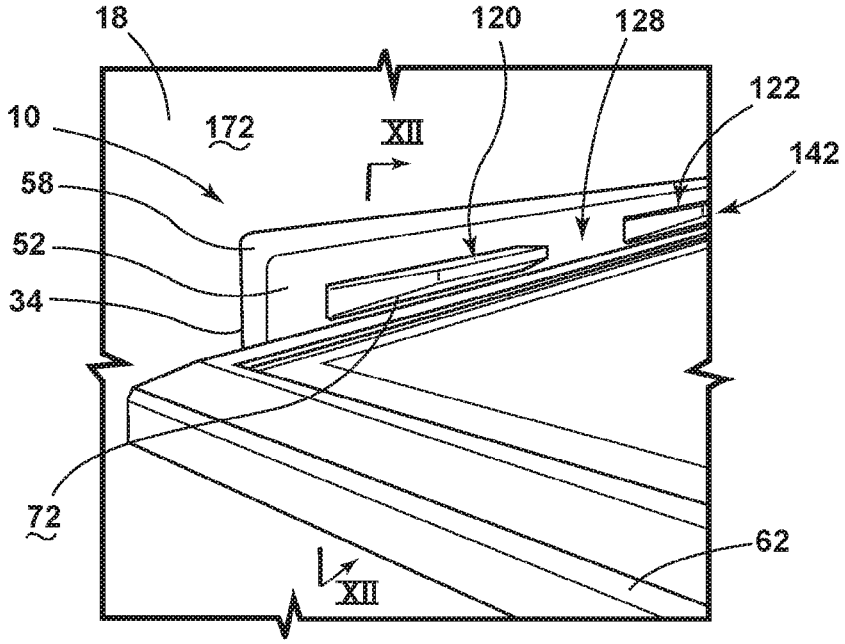
FIG. 11 is a cider perspective view of the shelf adjustment mechanism of FIG. 9 with a shelf supported on a lower support surface.

As exemplified in FIG. 7, where the shelf 62 is disposed on a lower support surface 80 of the shelf bracket 52, upward movement of the shelf 62 with respect to the shelf bracket 52 serves to engage the shelf 62 with the at least one angled biasing surface 72 of the upper support surface 92. This engagement between the shelf 62 and the angled support surfaces 50 biases the shelf bracket 52 outward and into the bracket cavity 60 of the bracket module 58 to define the recessed position 56. This movement of the shelf bracket 52 to the recessed position 56 provides clearance 82 for the shelf 62 to be moved upward and out of engagement with the shelf bracket 52. It is contemplated that vertical movement 70 of the shelf 62 from below the shelf bracket 52 can serve to engage at least one angled biasing surface 72 of the lower support surface 80 of the shelf bracket 52. This engagement can also serve to bias the shelf bracket 52 outward and at least partially into the bracket cavity 60 of the bracket module 58 to provide clearance 82 for the shelf 62 to pass by the lower support surface 80 of the shelf bracket 52. Once the shelf 62 is moved past the angled biasing surface 72 and above the lower support surface 80, a biasing mechanism 90 disposed between the shelf bracket 52 and the bracket module 58 biases the shelf bracket 52 outward to the securing position 54. When the shelf 62 is moved to a position between the upper and lower support surfaces 92, 80, the biasing mechanism 90 is allowed to bias the shelf bracket 52 outward to the securing position 54 such that the shelf 62 can be disposed on the lower support surface 80 of the shelf bracket 52. Accordingly, each of the upper and lower support surfaces 80, 82 can have a corresponding upper and lower angled biasing surface 72, respectively.

Referring again to FIGS. 1-8, a hinge 100 can extend from the bracket module 58 to the various shelf brackets 52. It is contemplated that the hinge 100 defines a rotational axis 102 of a corresponding shelf bracket 52. In such an embodiment, rotation of the at least one shelf bracket 52 about the corresponding rotational axis 102 defines the securing and recessed positions 54, 56 of the shelf bracket 52. In this embodiment, the biasing mechanism 90 can be a linear spring, coil spring, clock spring, constant force spring, torsion spring, and other similar biasing mechanisms 90 that serve to bias the shelf bracket 52 for rotational operation between the securing and recessed positions 54, 56. it is also contemplated that the shelf bracket 52 can be linearly operable between the securing and recessed positions 54, 56, such that the shelf bracket 52 is pressed in a substantially linear manner into the bracket cavity 60 of the bracket module 58. In such an embodiment, a linear spring is compressed as the shelf bracket 52 is moved into the bracket cavity 60 of the bracket module 58. Regardless of the type of biasing mechanism 90 or whether the shelf adjustment mechanism 10 includes the hinge 100 or is linearly operable, it is contemplated that the shelf bracket 52 is operable from the securing position 54 to the recessed position 56 by hand and without the use of tools.

Referring again to FIGS. 2-7, according to at least one aspect of the shelf adjustment mechanism 10, the bracket module 58 is adapted to contain a single shelf bracket 52 with multiple bracket modules 58 spaced throughout the appliance 12. In this embodiment, the shelf bracket 52 includes upper and lower support surfaces 92, 80. It is contemplated that each support surface 50 can have an angled biasing surface 72 disposed below each of the upper and lower support surfaces 92, 80. Accordingly, the shelf 62 can be moved from below the shelf bracket 52 to either of the lower and upper support surfaces 80, 92. This can be accomplished by progressively moving the shelf 62 upward into engagement with the angled biasing surface 72 proximate the lower support surface 80, past the lower support surface 80, into engagement with the angled biasing surface 72 below the upper support surface 92, and then past the upper support surface 92. Once the shelf 62 is above either of the upper or lower support surfaces 92, 80, the shelf 62 can only be moved in a downward direction through manual manipulation of the shelf bracket 52, typically by hand and without the use of tools. This manual operation of the shelf bracket 52 to the recessed position 56 provides the clearance 82 to allow the shelf 62 to move downward either from the upper support surface 92 to the lower support surface 80 or from the lower support surface 80 to an area below the shelf bracket 52.

Referring again to FIGS. 1-8, the various support surfaces 50 of the shelf bracket 52 can include elongated and continuous support surfaces that extend substantially the depth 110 of the inner liner 18 and along substantially the entire length of the opposing lateral edges 112 of the shelf 62. This configuration provides for a bracket module 58 that is larger than the elongated configuration of the shelf bracket 52. In such an embodiment, manipulation of the elongated support surfaces 50 can be done manually in two operations, where the user of the appliance 12 manipulates the shelf bracket 52 on a right side of the appliance 12 to the recessed position 56, moves the shelf 62 downward, and then manipulates the shelf bracket 52 on the left side of the appliance 12 (or vice versa) to the other side of the shelf 62 to the desired position within the shelf bracket 52.

Referring now to FIGS. 9-12, it is contemplated that the various support surfaces 50 of the shelf bracket 52 can be separated into front and rear supports 120, 122. In such an embodiment, a front support 120 is adapted to support a front portion 124 of the shelf 62 and a rear support 122 is adapted to support a rear portion 126 of the shelf 62. It is contemplated that the front and rear supports 120, 122 can be defined within a single shelf bracket 52, as exemplified in FIGS. 9-12. In this embodiment, the shelf bracket 52 includes a central space 128 within the shelf bracket 52, where the support surfaces 50 do not extend through the central space 128. Rather, the support surfaces 50 are, as described above, split between the front and rear supports 120, 122.

Figure 12:
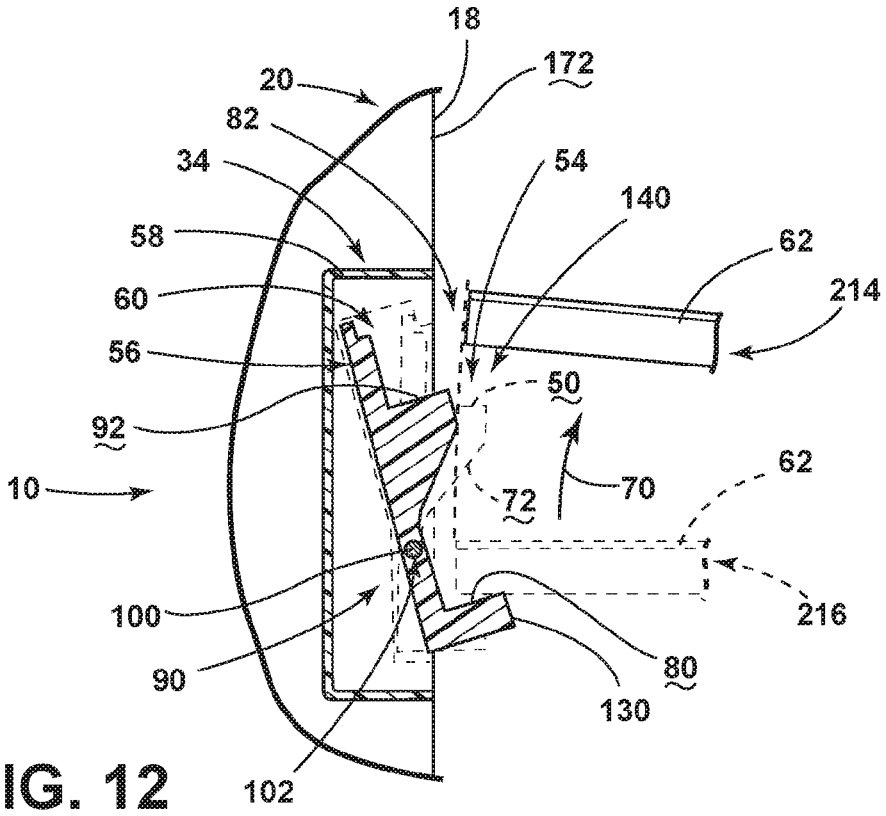
FIG. 12 is a cross-sectional view of the shelf adjustment mechanism of FIG. 11 taken along line XII-XII and showing the shelf adjustment mechanism in the securing and rest positions.
Figure 13:
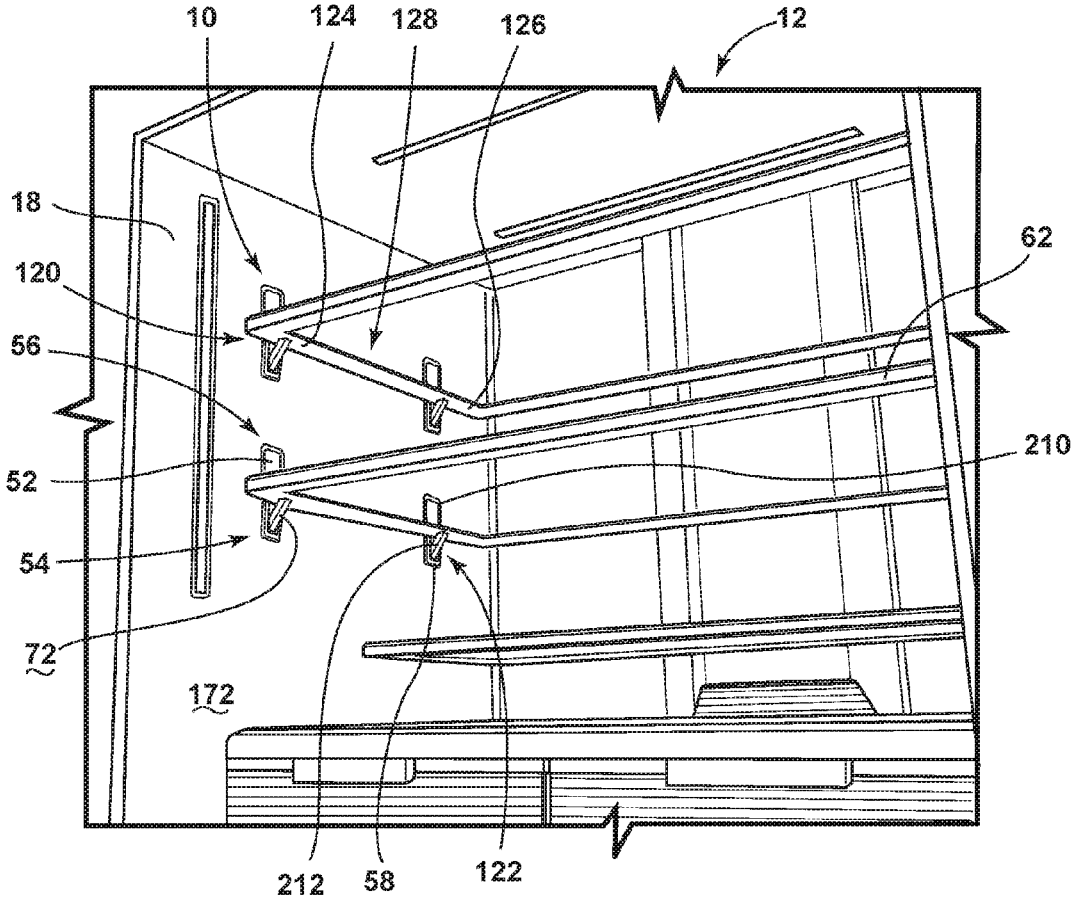
FIG. 13 is a front perspective view of a refrigerating compartment of an appliance incorporating an aspect of the shelf adjustment mechanism.
Figure 14:
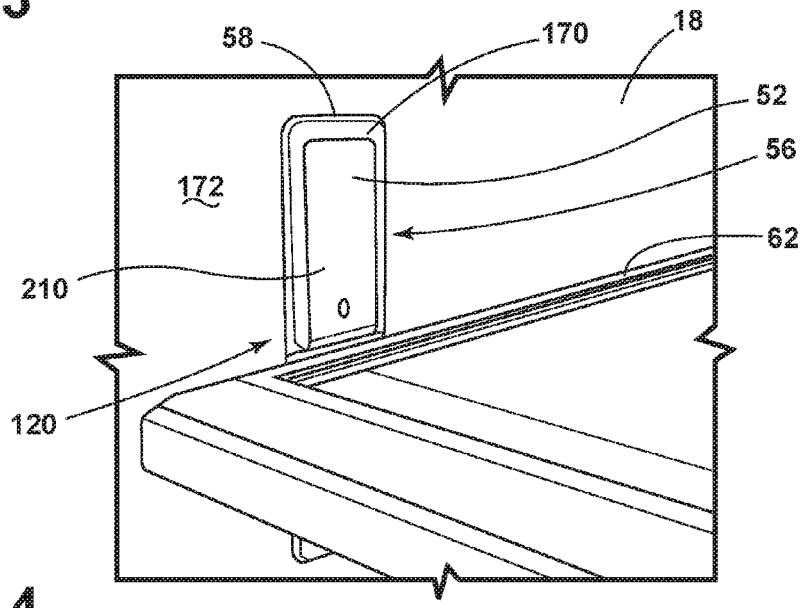
FIG. 14 is an enlarged perspective view of the shelf adjustment mechanism of FIG. 13 shown with a shelf installed on a lower support surface.
Figure 15:
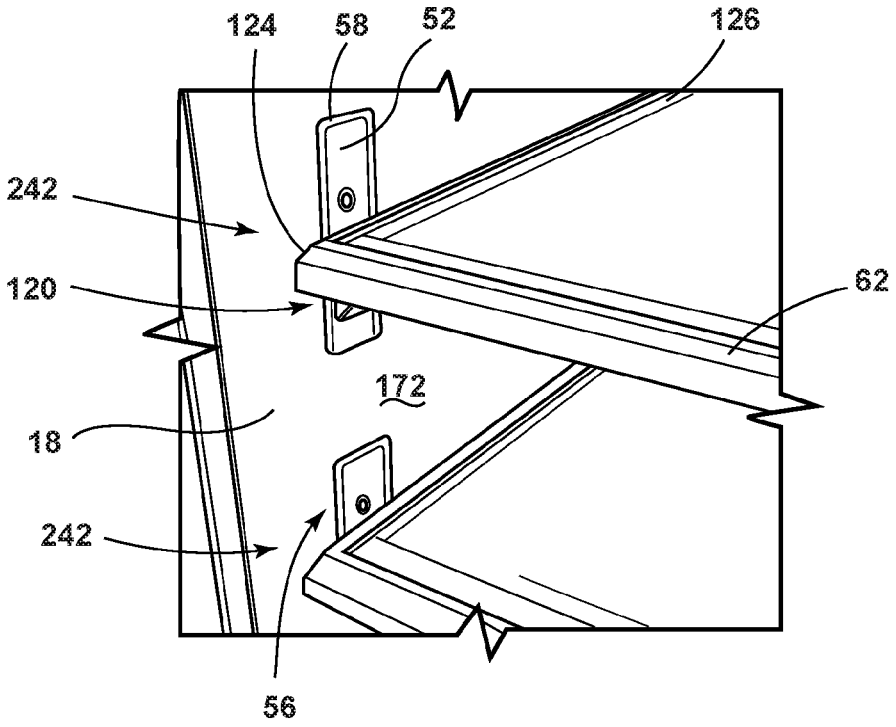
FIG. 15 is a top perspective view of the shelf adjustment mechanism of FIG. 13.
Figure 16:
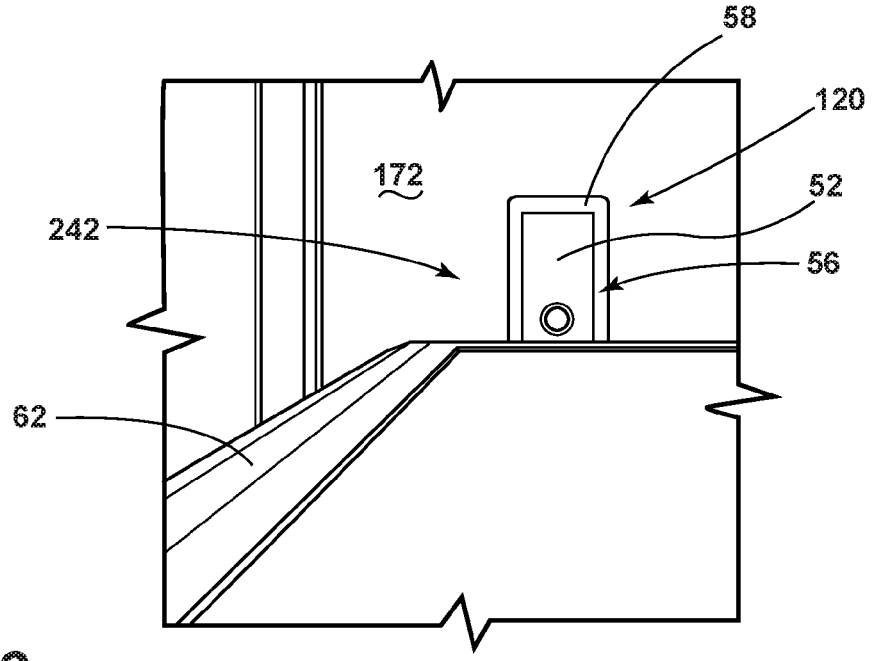
FIG. 16 is a side perspective view of the shelf adjustment mechanism of FIG. 15.
Figure 17:
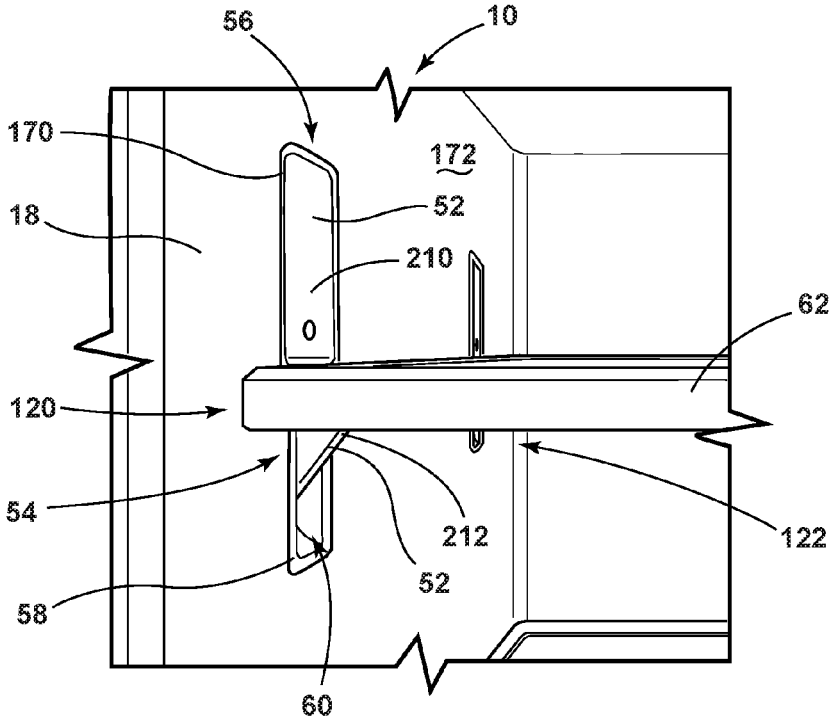
FIG. 17 is a front perspective view of the shelf adjustment mechanism of FIG. 16.
Figure 18:
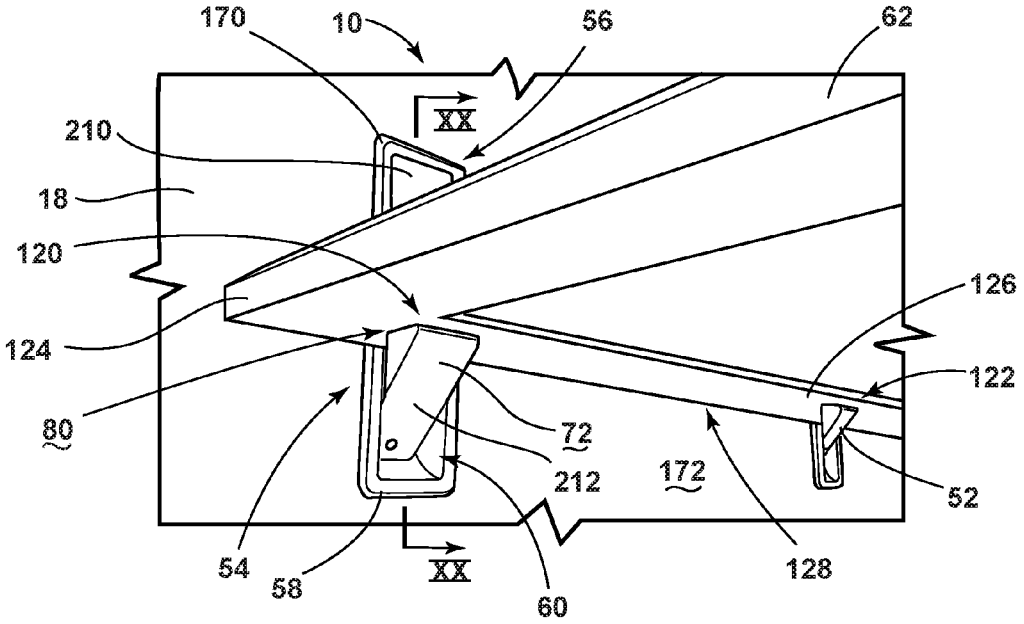
FIG. 18 is a bottom perspective view of the shelf adjustment mechanism of FIG. 17.
Figure 19:
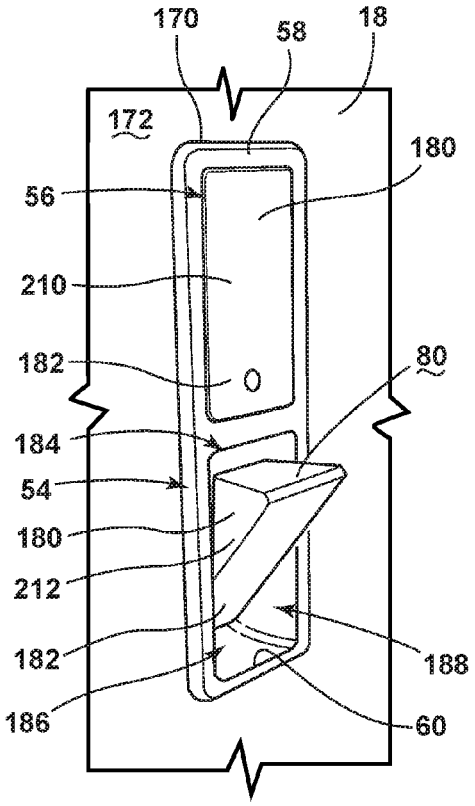
FIG. 19 is a side perspective view of the shelf adjustment mechanism of FIG. 14 shown with the shelf removed.
Figure 20:
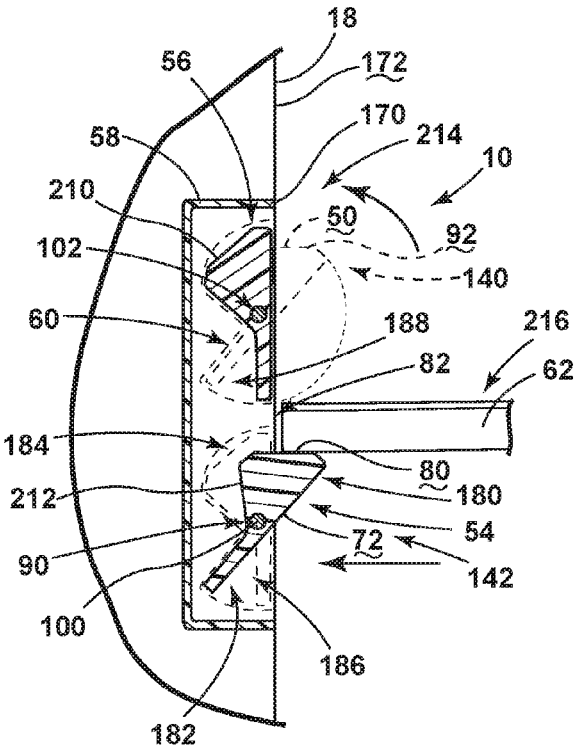
FIG. 20 is a cross-sectional view of the shelf adjustment mechanism of FIG. 18 taken along line XX-XX and showing the secured and recessed positions of the shelf brackets.
Figure 21:
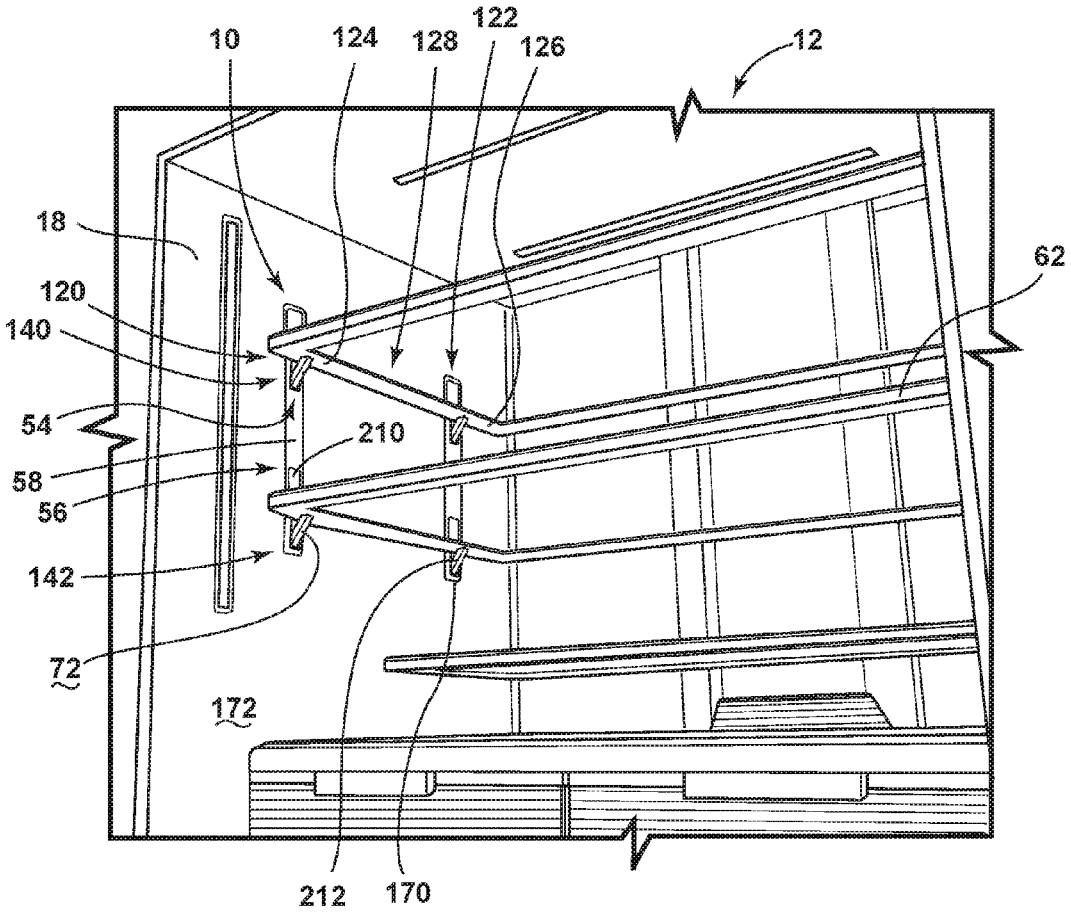
FIG. 21 is a front perspective view of a refrigerating compartment of an appliance incorporating an aspect of the shelf adjustment mechanism.
Figure 22:
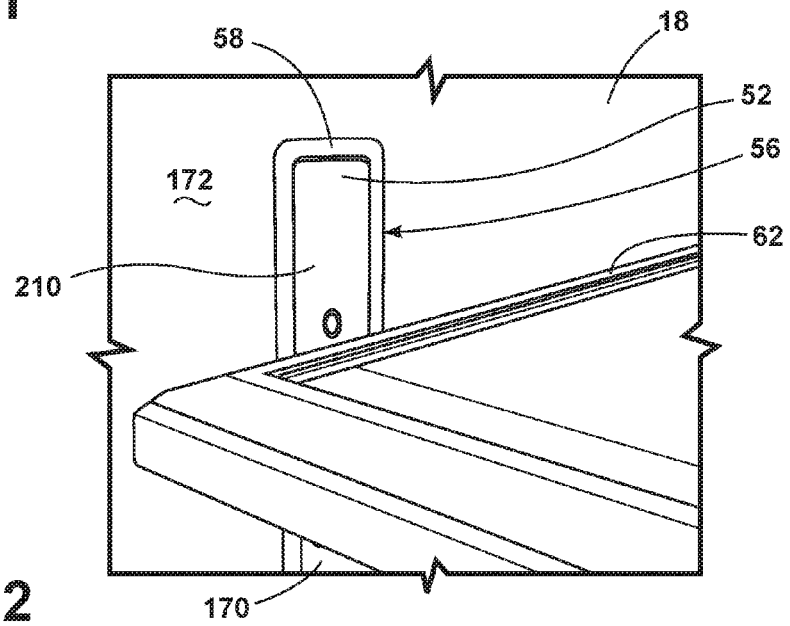
FIG. 22 is an enlarged perspective view of the shelf adjustment mechanism of FIG. 21 shown with a shelf installed on a lower support surface.
Figure 23:
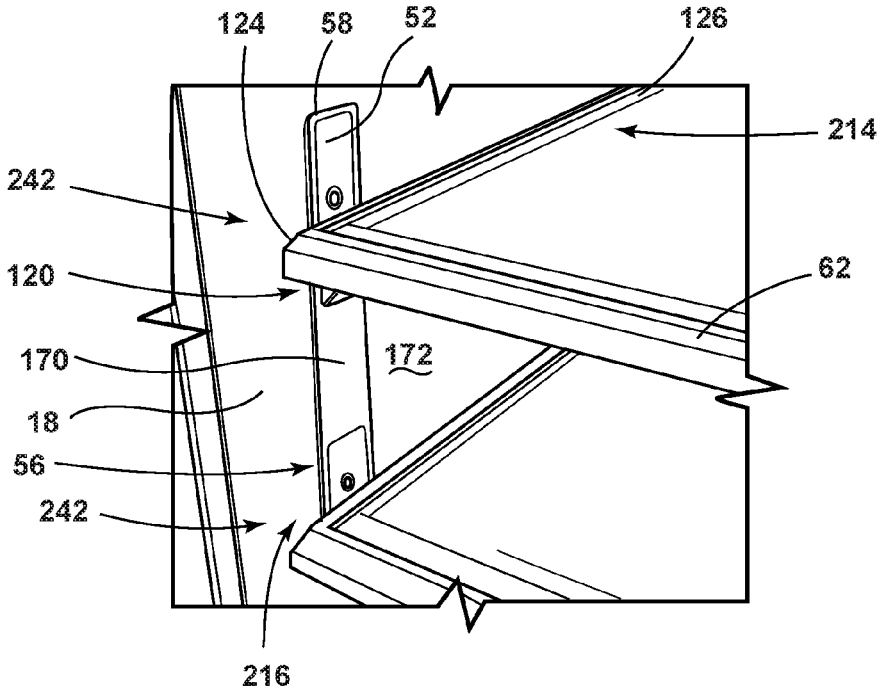
FIG. 23 is a top perspective view of the shelf adjustment mechanism of FIG. 21.
Figure 24:
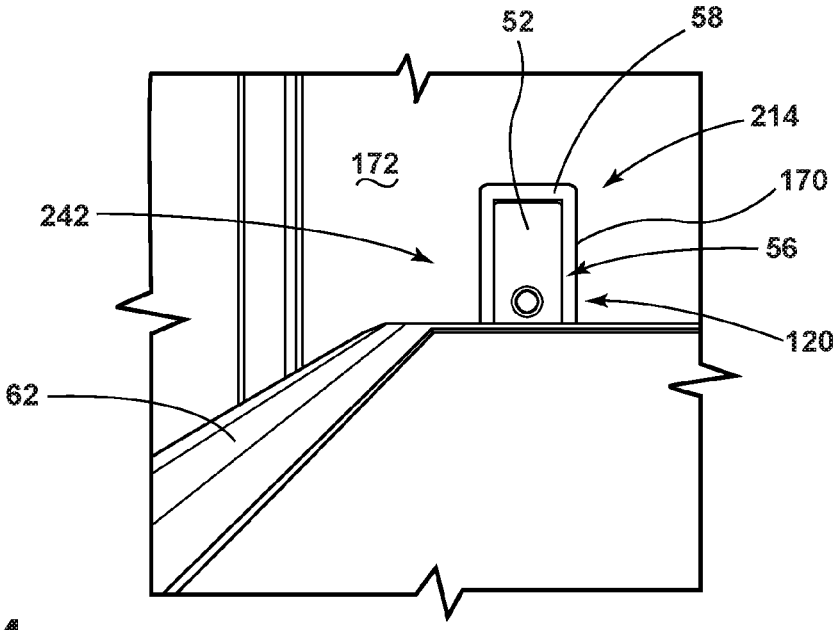
FIG. 24 is a side perspective view of the shelf adjustment mechanism of FIG. 23.
Figure 25:
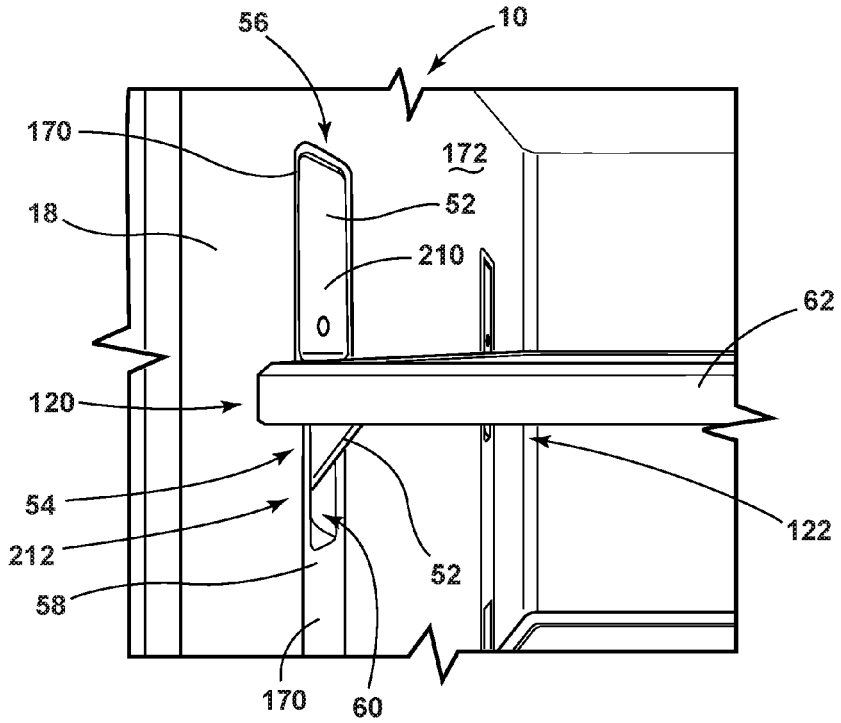
FIG. 25 is a front perspective view of the shelf adjustment mechanism of FIG. 24.
Figure 26:
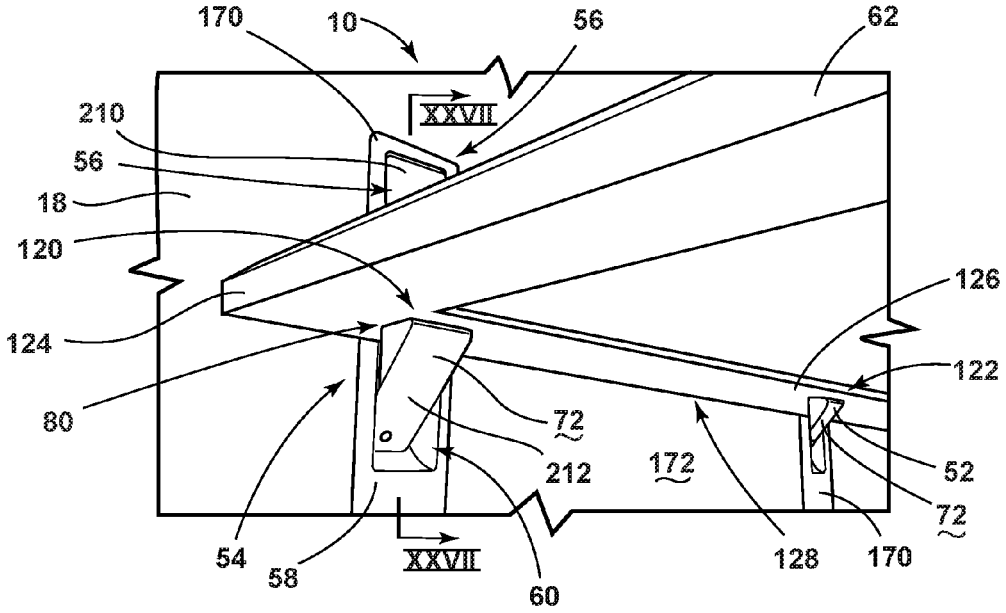
FIG. 26 is a bottom perspective view of the shelf adjustment mechanism of FIG. 25.
Figure 27:
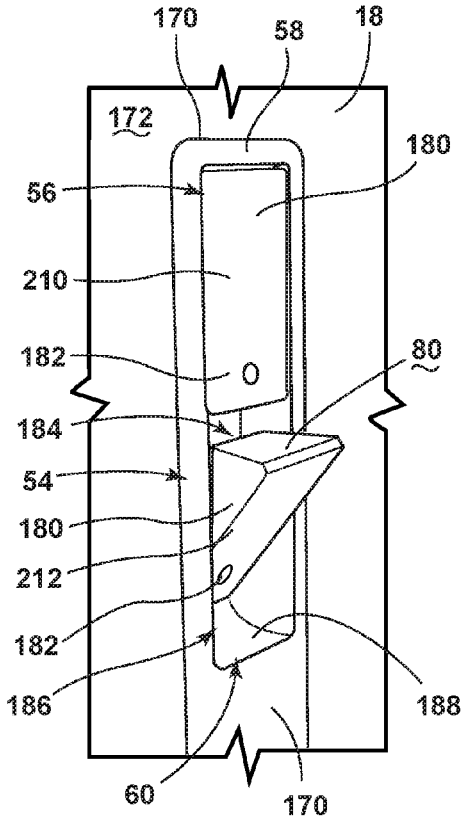
FIG. 27 is a side perspective view of the shelf adjustment mechanism of FIG. 22 shown with the shelf removed.
Figure 28:
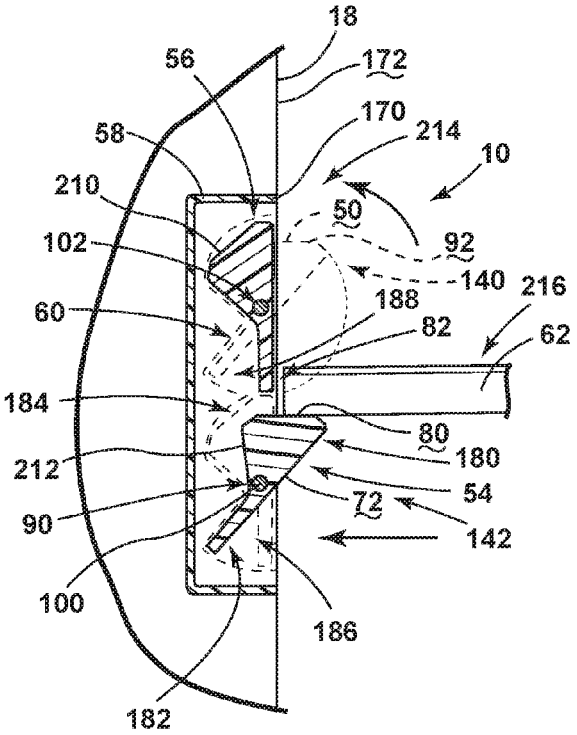
FIG. 28 is a cross-sectional view of the shelf adjustment mechanism of FIG. 26 taken along line XXVIII-XXVIII.
Figure 29:
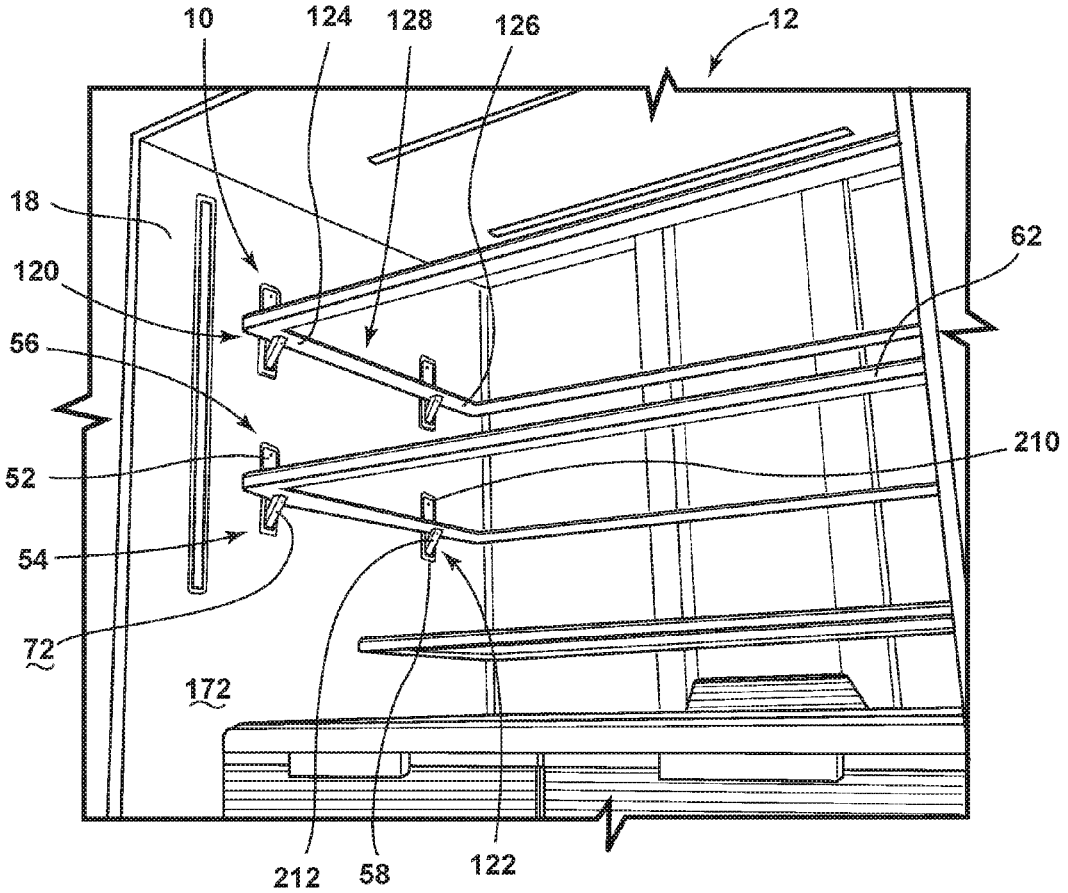
FIG. 29 is a front perspective view of a refrigerating compartment of an appliance incorporating an aspect of the shelf adjustment mechanism.
Figure 30:
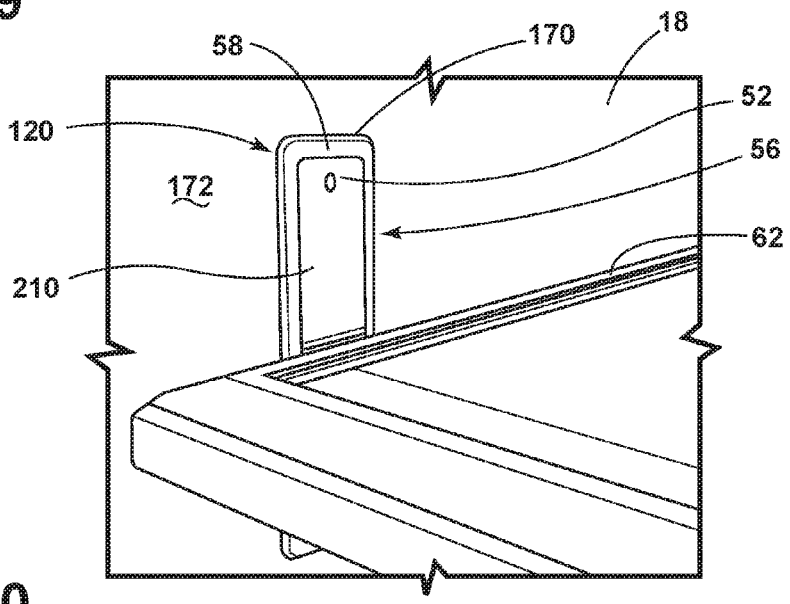
FIG. 30 is an enlarged perspective view of the shelf adjustment mechanism of FIG. 29 shown with a shelf installed on a lower support surface.
Figure 31:
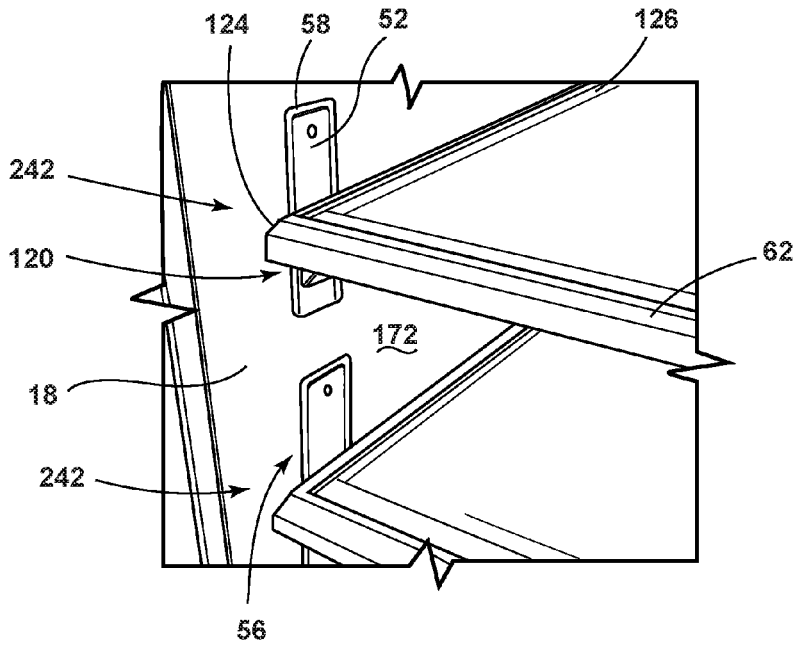
FIG. 31 is a top perspective view of the shelf adjustment mechanism of FIG. 29.
Figure 32:
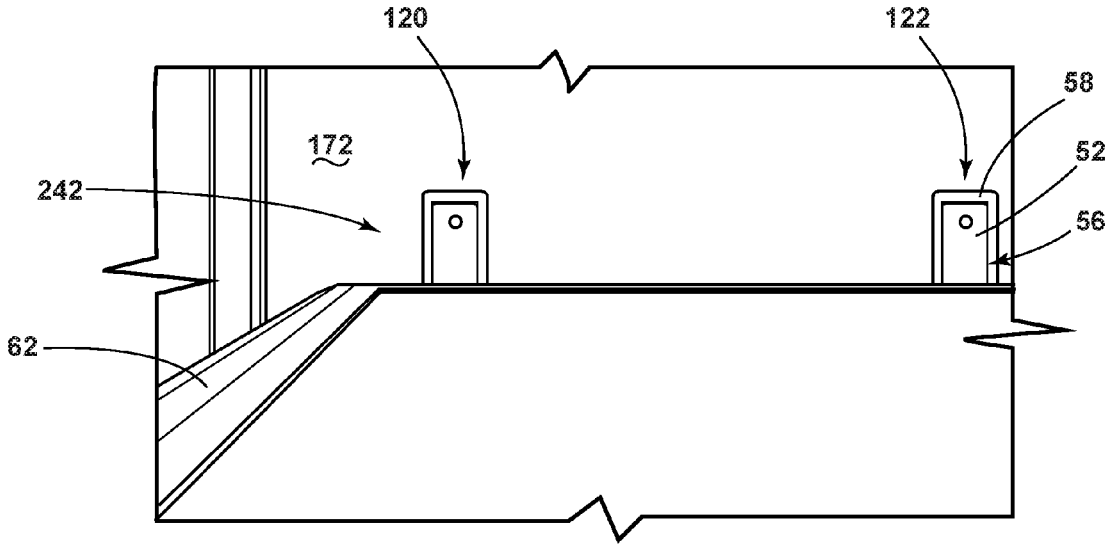
FIG. 32 is a side perspective view of the shelf adjustment mechanism of FIG. 31.
Figure 33:
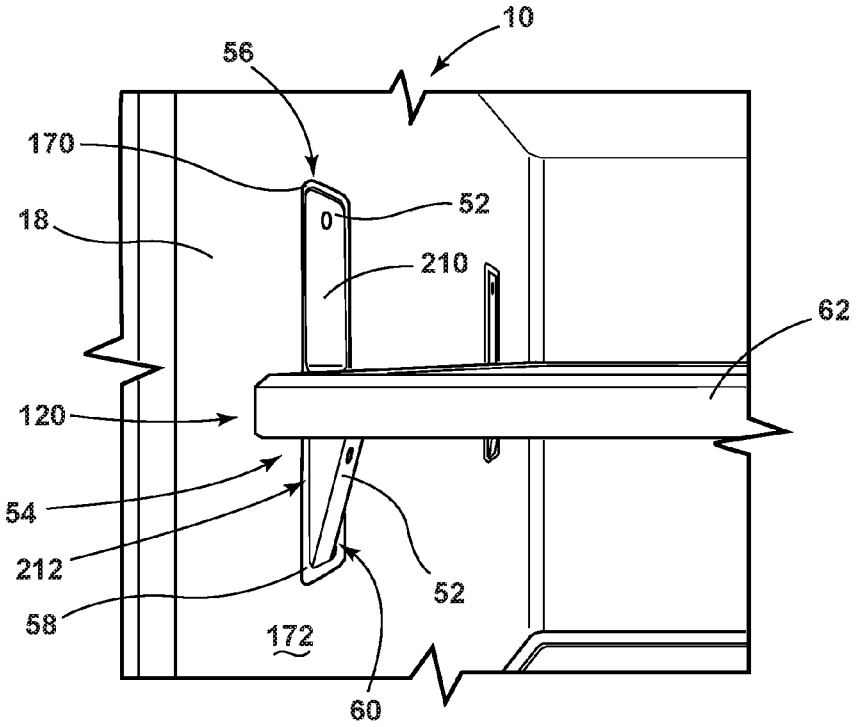
FIG. 33 is a front perspective view of the shelf adjustment mechanism of FIG. 32.
Figure 34:
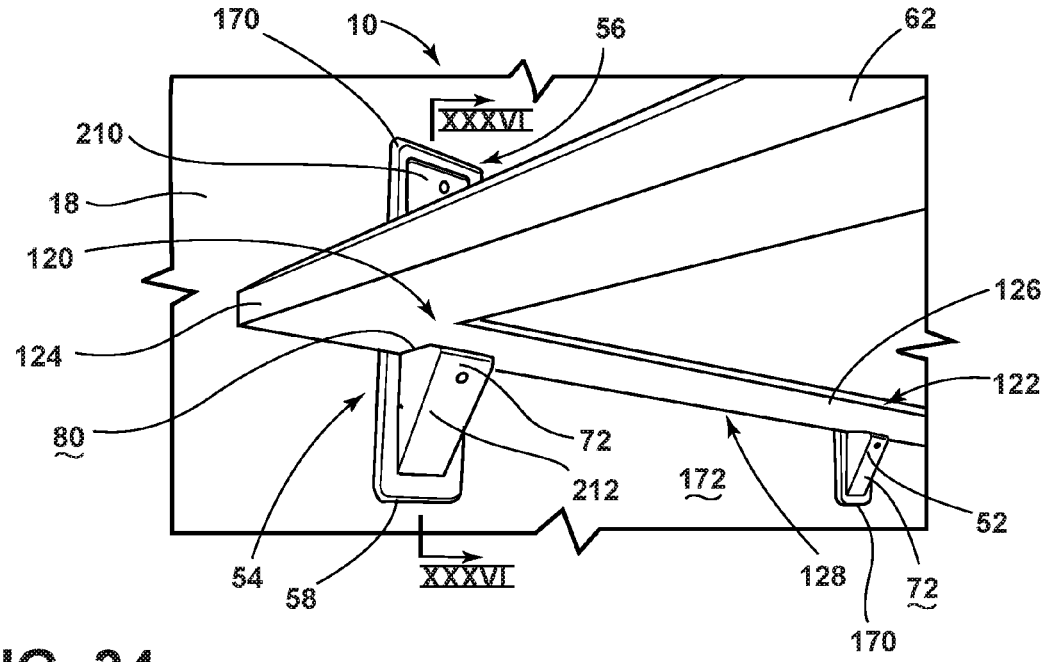
FIG. 34 is a bottom perspective view of the shelf adjustment mechanism of FIG. 33.
Figure 35:
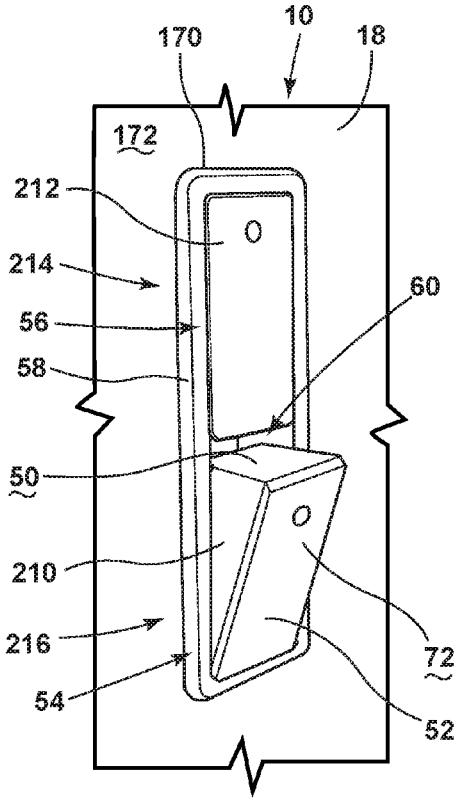
FIG. 35 is a side perspective view of the shelf adjustment mechanism of FIG. 30 shown with the shelf removed.
Figure 36:
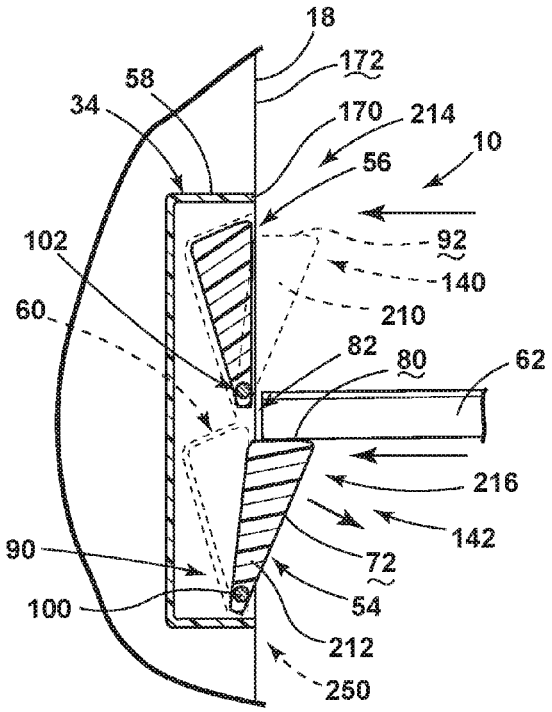
FIG. 36 is a cross-sectional view of the shelf adjustment mechanism of FIG. 34 taken along line XXXVI-XXXVI and showing the shelf brackets in the securing and recessed positions.

As exemplified in FIG. 12, it is contemplated that only one of the support surfaces 50 within the shelf bracket 52 having upper and lower support surfaces 92, 80 may include the angled biasing surface 72. Accordingly, it is contemplated that only the upper support surface 92 includes a corresponding angled biasing surface 72. In such an embodiment, the shelf 62 can be moved upward from the lower support surface 80 to the upper support surface 92, simply by moving the shelf 62 in an upward direction and allowing the shelf 62 to engage the angled biasing surface 72 proximate the upper support surface 92 to bias the shelf bracket 52 from the securing to the recessed positions 54, 56.

Referring again to FIG. 12, it is contemplated that the lower support surface 80 is a blocking feature 130 that includes no angled biasing surface 72 below the lower support surface 80. In such an embodiment, the shelf 62 cannot typically be moved vertically from below the shelf bracket 52 and into engagement with the lower support surface 80 without manually manipulating the shelf bracket 52 to move the lower support surface 80 into the recessed position 56 or by lowering the shelf 62 from above the shelf bracket 52 in the recessed position 56. It is contemplated that such a configuration of the shelf bracket 52 having the blocking feature 130 serves to prevent the shelf bracket 52 from being moved below the shelf bracket 52 and potentially being dropped onto another portion of the appliance 12 or another item. Accordingly, vertical movement 70 of the shelf 62 within the various support surfaces 50 of the shelf bracket 52 can either be from above and downward to the upper or lower support surfaces 92, 80, or can be upward from the lower support surfaces 80 to upper support surface 92 through the shelf 62 biasing the shelf bracket 52 into the recessed position 56 as it is moved in a vertically upward direction.

According to the various embodiments of the device as exemplified in FIGS. 2-12, it is contemplated that each shelf bracket 52 can include upper and lower support surfaces 92, 80 that define both the upper and lower support positions 140, 142 of the shelf 62, respectively, within that particular shelf bracket 52.

Referring again to FIGS. 1-12, it is contemplated that each shelf 62 is supported by at least two shelf brackets 52 positioned on opposing lateral edges 112 of the shelf 62. These shelf brackets 52, as discussed above, are positioned within opposing walls of the appliance 12, or within opposing sides of an interior storage space 26 of one of the operable panels 22, such as a door dyke 150. In the case of the shelf adjustment mechanism 10 within a door dyke 150, the various shelf brackets 52 and bracket modules 58 can be positioned to provide a plurality of support surfaces 50 for shelves 62, bins 160, and other storage options within the interior cavity defined by the inner liner 18 of the operable panel 22. It is contemplated that any of the embodiments described herein can be used in either of the interior cavity of the appliance 12, or within any of the operable panels 22 of the appliance 12. It is also contemplated that certain aspects of the shelf adjustment mechanism 10 can be used within different portions of a particular appliance 12.

Referring now to FIGS. 14-20, it is contemplated that a single bracket module 58 can include multiple shelf brackets 52. In such an embodiment, the shelf brackets 52 can be removed from a recessed position 56 that is defined by the shelf bracket 52 being flush with an outer edge 170 of the bracket module 58 and potentially an inward surface 172 of the inner liner 18. In such an embodiment, it is contemplated that each shelf bracket 52 can include a supporting portion 180 and an operating portion 182. According to the various embodiments, the supporting portion 180 can include at least one support surface 50 that is adapted to receive a lateral edge 112 of the shelf 62. The operating portion 182 of the shelf bracket 52 is adapted to be manipulated by the user to move the shelf bracket 52 from the recessed position 56 to the securing position 54. It is contemplated that the bracket cavity 60 of the bracket module 58 can be adapted to provide for rotational operation of the shelf bracket 52 between the recessed and securing positions 56, 54. Where the securing position 54 is defined by the supporting portion 180 being moved outside of the bracket cavity 60, the securing position 54 is also defined by the operating portion 182 being moved into the bracket cavity 60. In this embodiment, the operating portion 182 and supporting portion 180 each rotate around the hinge 100 that extends from the bracket module 58 to each shelf bracket 52. Accordingly, the operating portion 182 and supporting portion 180 each rotate around on opposing sides of the hinge 100.

According to various embodiments, the hinge 100 can be positioned at a lower portion 186 of the shelf bracket 52. In such an embodiment, the shelf bracket 52 can have a supporting portion 180 and an operating portion 182 that are defined within the same part of the shelf bracket 52, such as in the various embodiments exemplified in FIGS. 29-38.

Referring again to FIGS. 14-20, it is contemplated that the bracket cavity 60 can have an upper portion 184 that substantially matches the shape of the supporting portion 180 of the shelf bracket 52. This upper portion 184 of the bracket cavity 60 serves to limit the inward rotation of the supporting portion 180 to stop at the flush recessed position 56. A lower portion 186 of the bracket cavity 60 can be a hollow space 188 that allows the operating portion 182 of the shelf bracket 52 to rotate inside the lower portion 186 of the bracket cavity 60 to define the securing position 54.

Referring again to FIGS. 13-38, it is contemplated that the shelf bracket 52 having the securing position 54 and the operating portion 182 can be biased toward one of the recessed position 56 or the securing position 54 through a biasing mechanism 90 that rotationally biases the shelf bracket 52 to one of the securing and recessed positions 54, 56. The shelf bracket 52 can also be weighted or balanced relative to the hinge 100 such that the shelf bracket 52 can be retained, alternatively in the securing and recessed positions 54, 56. It is also contemplated that the shelf bracket 52 according to this and the various aspects of the device can be operated through a push-push interface. Through the push-push interface, the shelf bracket 52 is pushed once to move the shelf bracket 52 from the securing position 54 to the recessed position 56. The shelf bracket 52 can then be pushed again to move the shelf bracket 52 from the recessed position 56 to the securing position 54 (or vice versa). Through the use of the push-push interface, a biasing mechanism 90 is incorporated to bias the shelf bracket 52 to one of the securing and recessed positions 54, 56. Typically, the biasing mechanism 90 serves to bias the shelf bracket 52 to the securing position 54. The push-push mechanism also includes a latch mechanism that operates against the biasing mechanism 90 to retain the shelf bracket 52 in the recessed position 56.

Referring again to FIGS. 13-19, it is contemplated that a shelf 62 can be supported within a particular shelf position by four separate shelf brackets 52 positioned around the four corners of the structural cabinet 14 within the inner liner 18. It is contemplated that each shelf bracket 52 includes a dedicated bracket module 58 that receives one or more shelf brackets 52. As exemplified in FIGS. 13-19, the bracket module 58 includes upper and lower shelf brackets 210, 212 that are positioned around the four corners of each shelf 62 to define upper and lower shelf positions 214, 216 with respect to each bracket module 58. The use of the four separate bracket modules 58 within each shelf position minimizes the intrusion of the various bracket modules 58 within the liner recesses 34 defined within the inner liner 18. This also minimizes the intrusion within the insulating capacity and interstitial space for running utilities through the structural cabinet 14.

As will be described more fully below, in order to conveniently operate the various shelf brackets 52 spaced around the four corners of the interior compartment, a front and rear supports 120, 122 defined within separate shelf brackets 52 can be linked through a linkage member 230 that allows for unified movement of each of the front and rear supports 120, 122 through operation of only one of the front and rear supports 120, 122. In this manner, the front and rear supports 120, 122 are disposed in communication with one another such that operation of the front support 120 automatically operates the rear support 122. Similarly, operation of the rear support 122 serves to operate the front support 120 in a unified manner. Through the use of these linkage members 230, as typically exemplified in FIGS. 40-43, movement of the shelf 62 by manual manipulation of the various shelf brackets 52 can be performed through only two manipulating operations of opposing left and right shelf brackets 220, 222. Without the linkage member 230, it will be necessary to operate, independently, all four of the shelf brackets 52 to allow for vertical operation of the shelf 62 downward through the various support surfaces 50.

Referring now to FIGS. 13-28, it is contemplated that the various bracket modules 58 installed within the refrigerating compartment 30, interior storage space 26 or other interior compartment of the appliance 12 can include separate vertical positions of various bracket modules 58 that are independently positioned to define the various support positions of the shelves 62. It is also contemplated that a single bracket module 58 can extend vertically and substantially along the entire height 240 (shown in FIG. 1) of the interior compartment. In such an embodiment, a single bracket module 58 can include a plurality of shelf brackets 52 that are positioned along various vertical positions of the bracket module 58 to define the various shelf support positions 242 for retaining one or more shelves 62. It is contemplated that each shelf position within the bracket module 58 can include multiple support surfaces 50 within a shelf bracket 52 or within multiple shelf brackets 52. Accordingly, each shelf position that is spaced vertically within the interior compartment can define multiple finite support positions (typically two) within that particular shelf position.

According to the various embodiments, the selection of whether to use a single full-height bracket module 58 that includes multiple shelf brackets 52 or multiple vertically spaced and smaller bracket modules 58 can be dictated through the particular design of the appliance 12, the aesthetics desired for the appliance 12, the types of shelving included within the appliance 12, the positioning of the storage area within an interior compartment or proximate one of the door panels, and other various considerations.

Referring again to FIGS. 13-28, it is contemplated that within a single bracket module 58, each shelf bracket 52 can include its own dedicated bracket cavity 60 within the shelf module. It is also contemplated that within a particular shelf position having the finite positions defined therein, the bracket module 58 can also include a single bracket cavity 60 that houses multiple shelf brackets 52. Accordingly, within a single bracket cavity 60, as exemplified in FIG. 28, the two shelf brackets 52, defining upper and lower shelf brackets 210, 212, each define a corresponding upper and lower shelf position 214, 216. Each of the upper and lower shelf brackets 210, 212 serve to define finite upper and lower shelf positions 214, 216 within that portion of the bracket module 58 where the shelf 62 can be moved minimally upward or downward between the various finite positions. Where separate bracket cavities 60 are used, a portion of the bracket module 58 may extend between two separate shelf brackets 52. Alternatively, where a single bracket cavity 60 is used to house multiple shelf brackets 52, no division between the shelf brackets 52 will be seen other than the space between the respective shelf brackets 52.

Referring now to FIGS. 29-36, it is contemplated that upper and lower shelf brackets 210, 212 can be incorporated within a single bracket module 58. In such an embodiment, it is contemplated that each shelf bracket 52 can have its own dedicated hinge 100 that allows for separate and independent operation of each of the upper and lower shelf brackets 210, 212 between the recessed and securing positions 56, 54. In such an embodiment, each of the upper and lower shelf brackets 210, 212 can be biased outward in the securing position 54 and can also incorporate an aspect of the push-push mechanism, as described above. In this manner, the shelf 62 can be moved upward to engage the angled biasing surface 72 of each shelf bracket 52 to bias the shelf bracket 52 toward the recessed position 56 to allow for vertical movement 70 of the shelf 62 with respect to the shelf brackets 52.

As discussed previously, once the shelf 62 passes the particular shelf bracket 52, the biasing mechanism 90 moves the shelf bracket 52 back to the securing position 54 such that the shelf 62 can be rested upon a corresponding support surface 50 of that shelf bracket 52.

According to the various embodiments, it is contemplated that each of the upper and lower shelf brackets 210, 212 can be operated through the push-push mechanism described above where each of the upper and lower shelf brackets 210, 212 can be moved to a recessed position 56 and substantially flush with one or both of the bracket module 58 and/or the surface of the inner liner 18. It is contemplated that the use of the push-push mechanism can be incorporated within aspects of the shelf adjustment mechanism 10 having four independently operable shelf brackets 52 used to support the four corners of each shelf 62. Through the push-push mechanism, each of the shelf brackets 52 within the four corners can be pushed and locked into a recessed position 56 independently. When each of the shelf brackets 52 are moved to the recessed position 56, the shelf 62 can be moved downward to a lower support position 142 within the bracket module 58. Accordingly, the use of a push-push mechanism allows for convenient use of the shelf brackets 52 and bracket modules 58 without incorporating the linkage member 230 extending between the front and rear supports 120, 122. It is contemplated that the linkage member 230 can be used in conjunction with the push-push engagement mechanism for operating the various shelf brackets 52 within aspects of the shelf adjustment mechanism 10. As described above, it is contemplated that each of the upper and lower shelf brackets 210, 212 can include a single bracket cavity 60 or can have dedicated bracket cavities 60 within various portions of the bracket module 58.

Figure 37:
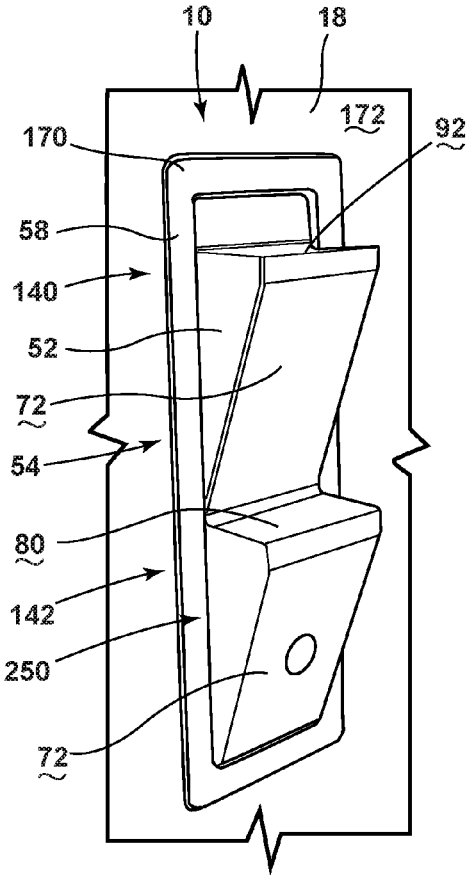
FIG. 37 is a perspective view of another aspect of the shelf adjustment mechanism.
Figure 38:
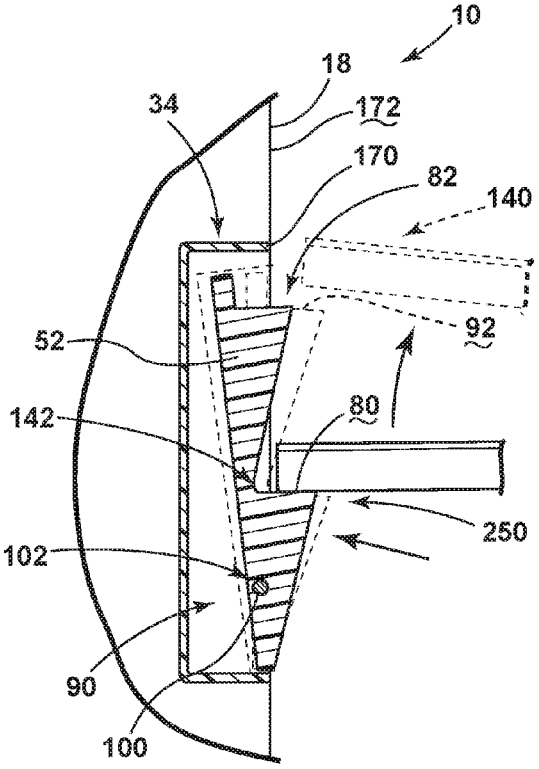
FIG. 38 is a cross-sectional view of the shelf adjustment mechanism of FIG. 37 taken along line XXXVIII-XXXVIII, and showing the shelf bracket in the securing and recessed positions.

Referring now to FIGS. 37 and 38, it is contemplated that various aspects of the shelf adjustment mechanism 10 can include fixed support 250 of the lower shelf bracket 212 that is substantially fixed in position or is substantially incapable of moving within the bracket cavity 60 of the bracket module 58. In such an embodiment, the shelf bracket 52 can be rotationally operable about the hinge 100, where the hinge 100 is positioned proximate the fixed support 250 of the lower support surface 80. With the hinge 100 so located, the lower support surface 80 can rotate about the hinge 100, but cannot rotate within the bracket cavity 60 of the bracket module 58. Accordingly, as the shelf bracket 52 is moved to the recessed position 56, the upper support surface 92 is moved into the bracket cavity 60 to allow for downward movement of the shelf 62 to the lower support surface 80. In this embodiment, the lower support surface 80 cannot be moved into the securing position 54 within the bracket cavity 60. Accordingly, the shelf 62 cannot move below the bracket cavity 60 without being pulled out and moved below the lower support surface 80. It is also contemplated that where separate shelf brackets 52 are included within a particular bracket module 58, the fixed support 250 of the lower shelf bracket 212 can be in a fixed position and inoperable, such that the lower shelf bracket 212 is permanently in the securing position 54. The upper shelf bracket 210, alternatively, can be manipulated between the securing and recessed positions 54, 56 to allow for movement of the shelf 62 between the lower support surface 80 and the upper support surface 92.

Figure 39:
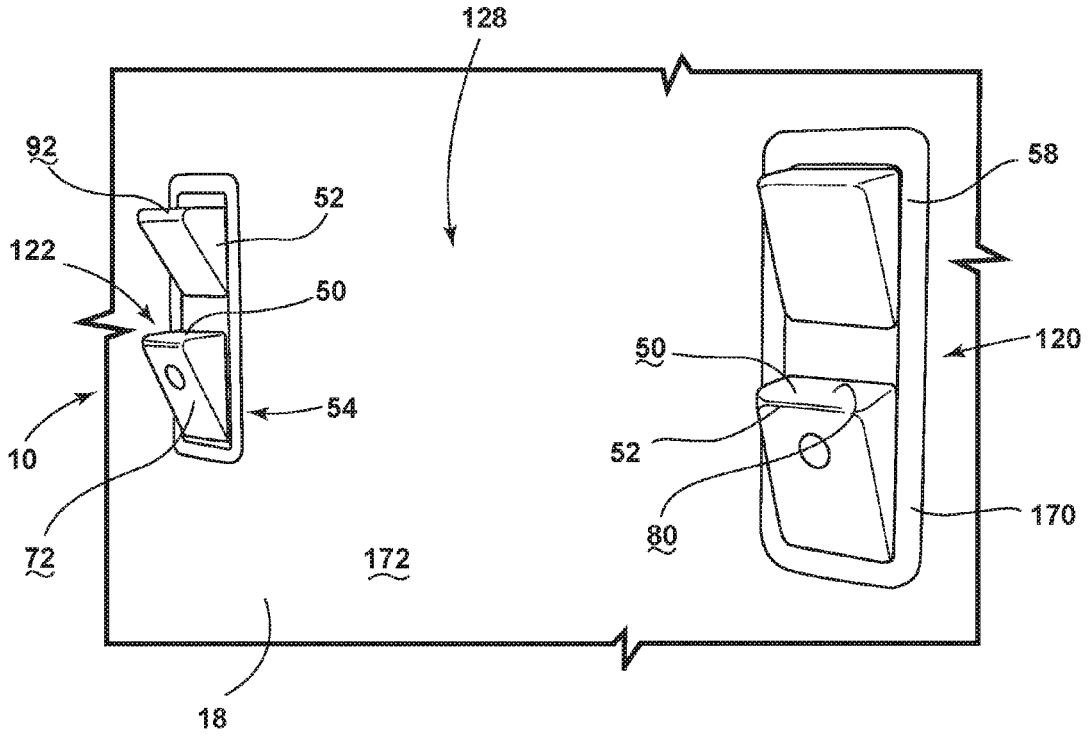
FIG. 39 is a perspective view of an aspect of the shelf adjustment mechanism showing independently operable front and rear supports of the various shelf brackets.

Referring now to FIG. 39, according to various aspects of the device, the various shelf brackets 52 that are spaced around the corners of each shelf 62 can be independently operable between the securing and recessed positions 54, 56. Typically, in such a configuration where the shelf brackets 52 are independently operable, a push-push mechanism can be incorporated.

Figure 40:
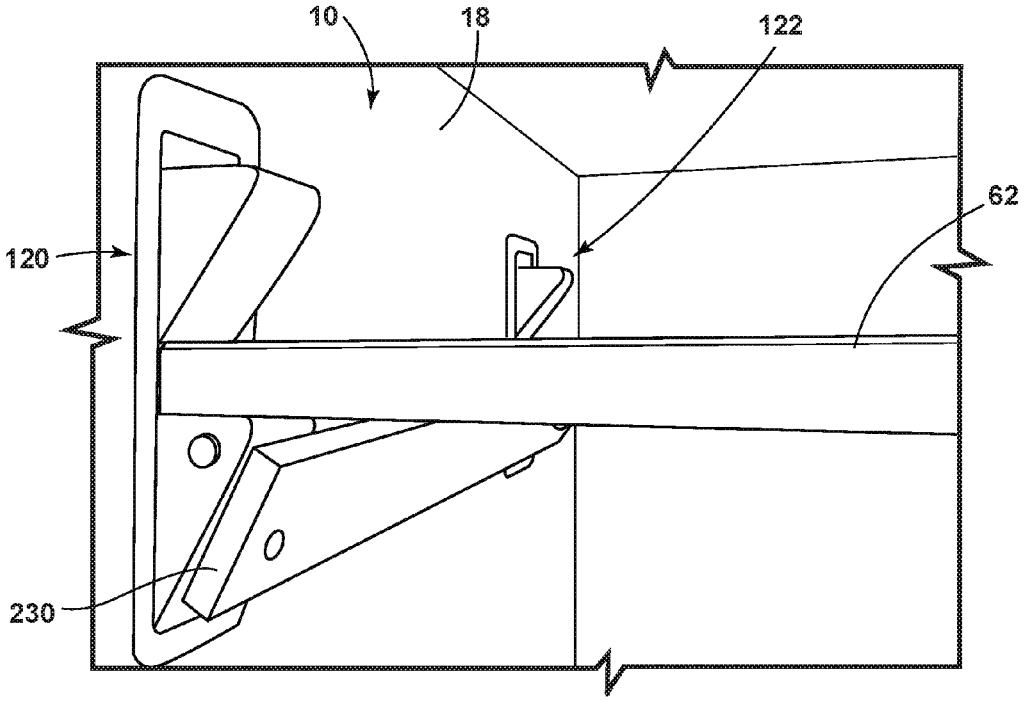
FIG. 40 is a perspective view of an aspect of the shelf adjustment mechanism incorporating a linkage member for providing unified operation of the front and rear supports.
Figure 41:
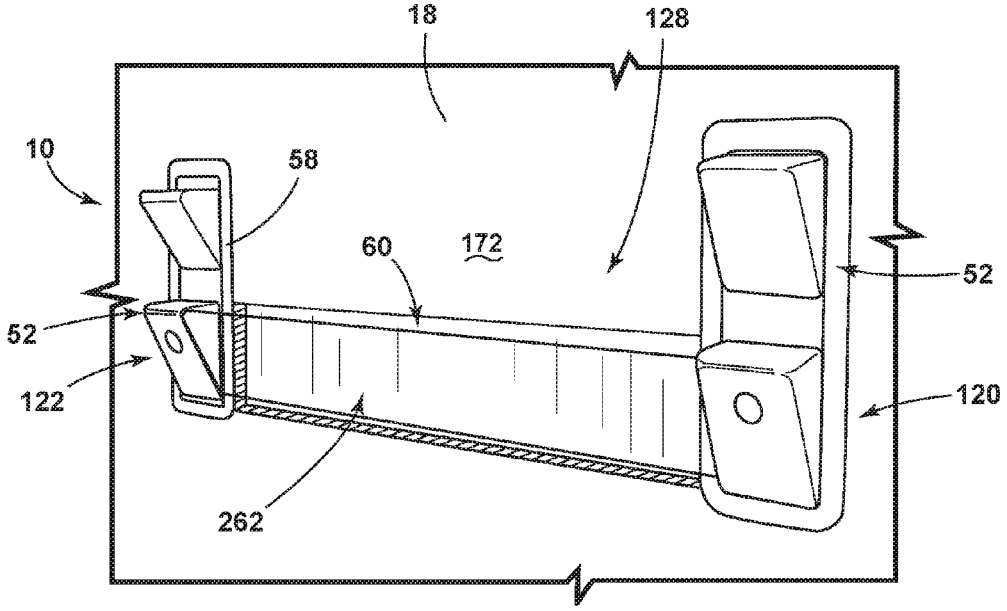
FIG. 41 is a perspective view of the shelf adjustment mechanism of FIG. 40 showing a recess in the inner liner of the appliance for receiving the linkage member in the recessed position.
Figure 42:
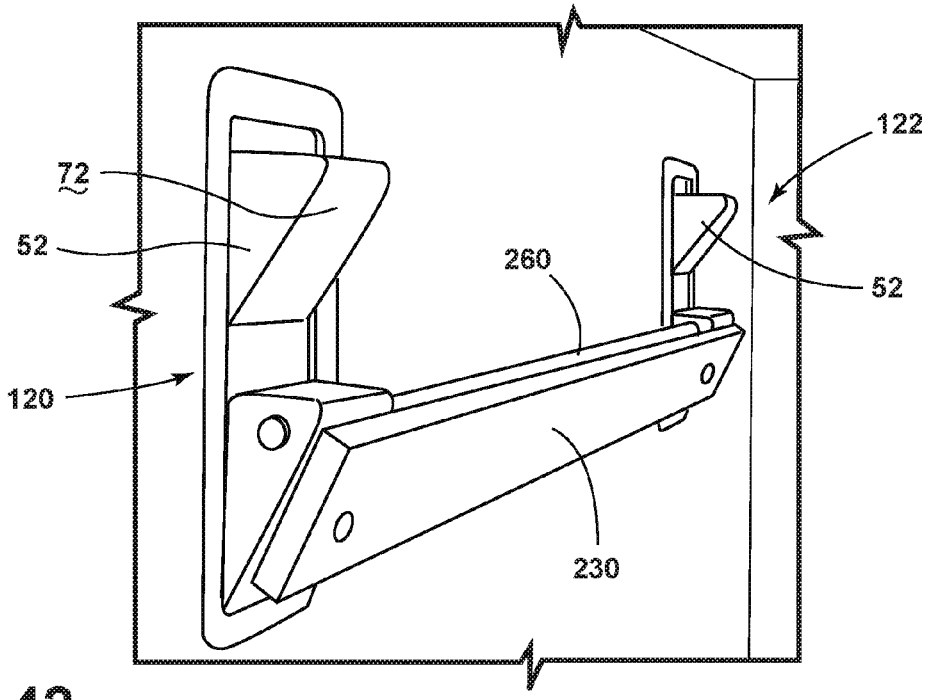
FIG. 42 is a perspective view of an aspect of the shelf adjustment mechanism including a linkage bar extending between the front and rear supports.
Figure 43:
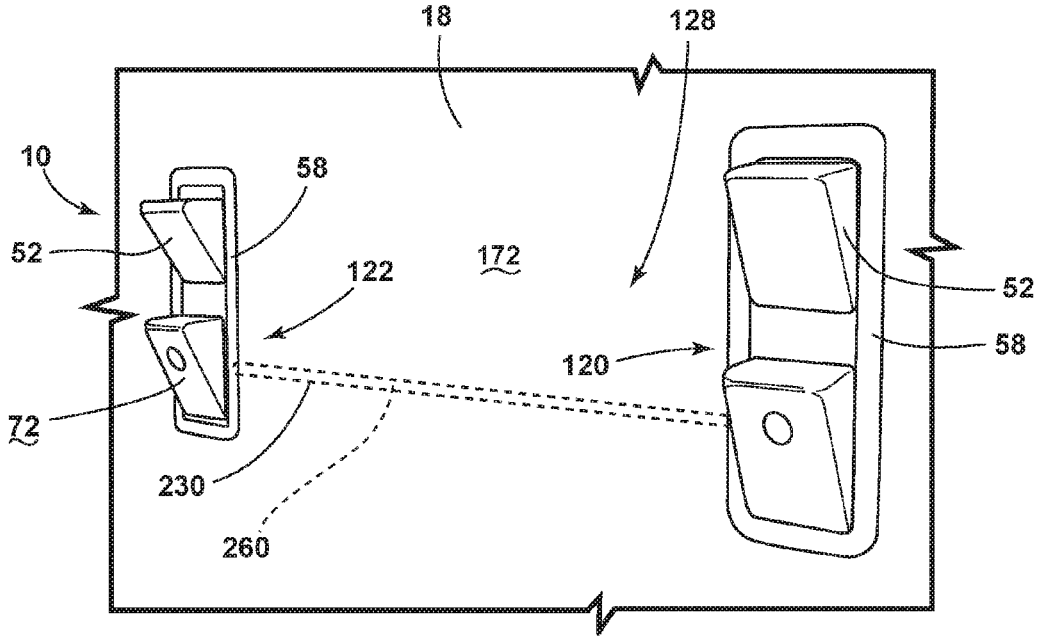
FIG. 43 is a perspective view of an aspect of the shelf adjustment mechanism showing a linkage rod extending between the front and rear supports and positioned within an interior cavity of the wall of the cabinet structure.

Referring now to FIGS. 40 and 41, shelf brackets 52 that define the front and rear supports 120, 122 can also include a linkage member 230 that extends between the front and rear supports 120, 122. This linkage member 230 can extend between the front and rear supports 120, 122 either exterior of the inner liner 18 or within a portion of the inner liner 18, such that the linkage member 230 is fully concealed. Through the use of the linkage member 230, the front and rear supports 120, 122 are in communication and are jointly operable in unison between the securing and recessed positions 54, 56 and back to the securing position 54. The use of the linkage member 230 can either incorporate or be free of a push-push interface for allowing operation of the various support surfaces 50 between the recessed and securing positions 56, 54. It is contemplated that the linkage member 230 can be a plate or elongated member that is positioned on an outer surface of each of the front and rear supports 120, 122 or can be a linkage bar 260 that extends through or attaches to an interior portion of each shelf bracket 52 that defines the front and rear supports 120, 122. In each of these configurations, it is contemplated that operation of the front support 120 serves to operate the rear support 122 automatically, and vice versa. Where the linkage member 230 is visible with the naked eye and is positioned outside of the inner liner 18, it is contemplated that the inner liner 18 can include a linkage recess 262 that allows for the linkage member 230 to be stored in a substantially flush configuration with the inward surface 172 of the inner liner 18 and/or the bracket module 58 when the front and rear supports 120, 122 of the various shelf brackets 52 are moved to the recessed position 56. Accordingly, the linkage member 230 moves to the recessed position 56 with the shelf brackets 52, and moves to the securing position 54 along with both of the front and rear supports 120, 122.

Figure 44:
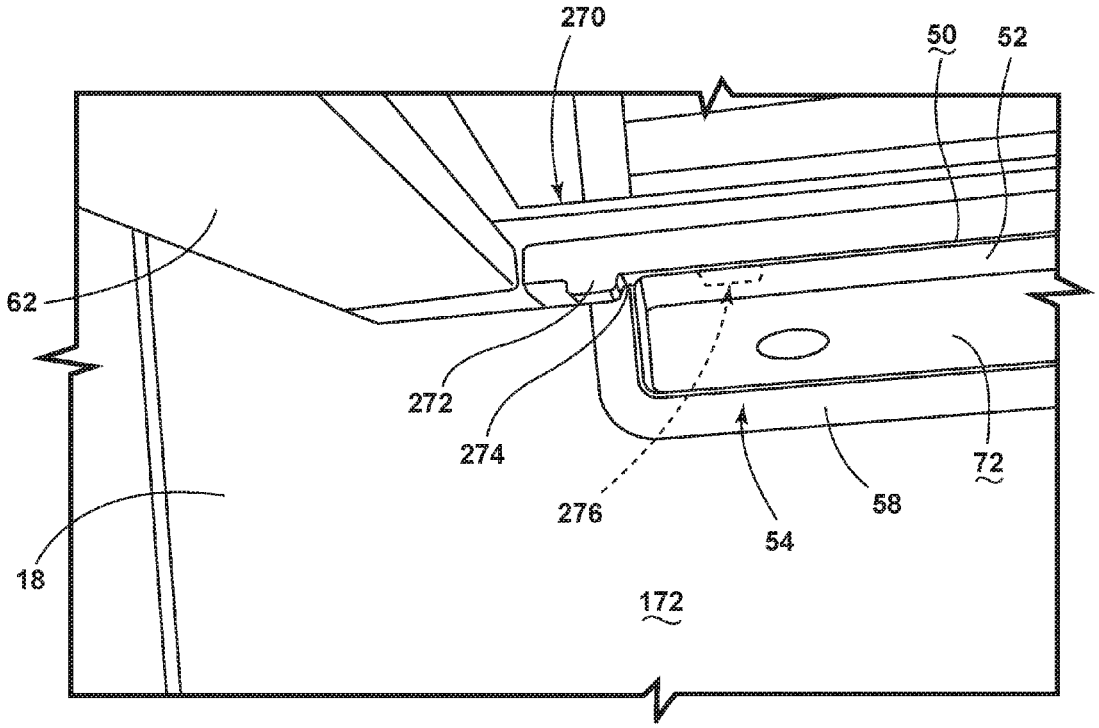
FIG. 44 is a perspective view of a lateral retaining mechanism incorporated within a shelf and an aspect of the shelf adjustment mechanism.
Figure 45:
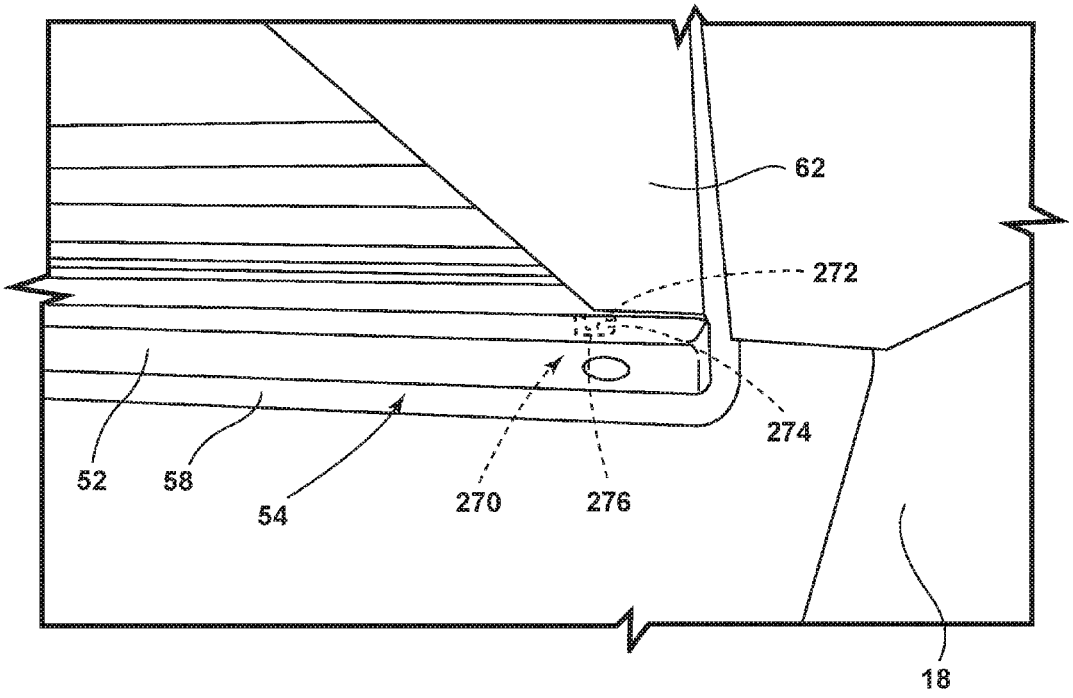
FIG. 45 is a perspective view of a lateral retaining mechanism incorporated within a shelf and an aspect of the shelf adjustment mechanism.

According to the various embodiments, as exemplified in FIGS. 1-44, the support surfaces 50 of the shelf brackets 52 serve to provide vertical support for the shelf 62 from below. It is also contemplated that the shelf 62 and the various support surfaces 50 can cooperate to define an at least partial and lateral support for the shelf bracket 52 to prevent inward and outward sliding movement of the shelf 62 when the shelf 62 is engaged in one of the shelf support positions 242 of the shelf adjustment mechanism 10. It is contemplated that the lateral retaining feature 270 of the shelf 62 and the shelf adjustment mechanism 10 can include various protrusions 272 and recesses, magnetic engagements, clipping engagements, other magnetic and/or mechanical engagements between the shelf 62 and the shelf adjustment mechanism 10. As exemplified in FIGS. 44 and 45, presented as a non-limiting example, the shelf 62 can include a downwardly extending protrusion 272 having angled sides 274 that are adapted to fit within a mating recess 276 defined within the support surface 50 of the shelf bracket 52 for the shelf adjustment mechanism 10. The angled surfaces of the protrusion 272 allow for a self-correcting feature of the engagement between the shelf 62 and the corresponding support surface 50. In this manner, placement of the shelf 62 near the mating recess 276 defined within the support surface 50 allows for engagement between the protrusion 272 and the mating recess 276 such that the protrusion 272 will slide into the recess and at least slightly manipulate the position of the shelf 62 laterally. In this manner, the protrusion 272 of the shelf 62 will slide into the mating recess 276 to bias the position of the entire shelf 62, such that the protrusion 272 will entirely be disposed within the mating recess 276.

It is also contemplated that the shelf 62 and the support surfaces 50 can include a magnetic retaining mechanism having opposing polarities disposed within the support surface 50 and the shelf 62. As the shelf 62 approaches the appropriate shelf support position 242, the opposing polarities of the magnetic attachment mechanism attracts to one another and serve to at least partially retain the shelf 62 in the desired support position. It is contemplated that the magnet within one of the shelf 62 and/or the shelf bracket 52 can be rotationally operable such that if the shelf 62 is rotated and matching polarities are achieved, one of the magnets can rotate to change polarities to the opposing polarity of the magnet positioned nearby.

According to the various embodiments, each of the various aspects of the shelf adjustment mechanism 10 disclosed herein can be incorporated within various appliances 12. Such appliances 12 can include, but are not limited to, refrigerators, freezers, coolers, ovens, other heating appliances, dishwashers, laundry-type appliances, and other similar appliances 12 and fixtures requiring adjustable shelving in residential and commercial settings.

According to the various embodiments, as exemplified in FIG. 1, it is contemplated that various aspects, or combinations of the various aspects of the shelf adjustment mechanism 10 can be included within a single refrigerating appliance 12. The various shelf adjustment mechanisms 10 can be incorporated within the interior cavity for supporting shelving within a refrigerating compartment 30 and/or freezing compartment 32. It is also contemplated that the shelf adjustment mechanism 10 can be incorporated within an interior storage space 26 defined by the inner liner 18 of an operable panel 22 such as a hinged door 24 or slidable drawer 28 of the refrigerating appliance 12. It is further contemplated that the shelf adjustment mechanism 10 can be used to support shelves 62, slidable bins 160, various modules, and other storage solutions that can be disposed within an appliance 12. It is further contemplated that various electrical interfaces can be incorporated between the engagement of the shelf 62 and the support surfaces 50 such that lighting, data, various communications, electricity, and other similar utilities can be run to a particular shelf 62 through the engagement of the shelf 62 with the various support surfaces 50 of the shelf adjustment mechanism 10.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A shelf adjustment mechanism for an appliance, the shelf adjustment mechanism comprising:

a shelf bracket having upper and lower support surfaces, wherein the shelf bracket is rotationally operable about a single pivot between a securing position and a recessed position;

a bracket module that rotationally receives the shelf bracket, wherein the securing position of the shelf bracket is defined by a substantially horizontal orientation of the upper and lower support surfaces with respect to the bracket module and the recessed position is defined by an angular orientation of the upper and lower support surfaces; and an angled biasing surface defined on the shelf bracket and proximate the upper support surface, wherein the angled biasing surface is configured to engage a shelf as the shelf is moved vertically along the angled biasing surface from a position between the upper and lower support surfaces and to a location above the upper support surface, wherein the shelf bracket is configured to be selectively operated from the securing position to the recessed position by engagement of the shelf with the angled biasing surface, wherein the recessed position is further defined by the upper support surface being recessed within the bracket module and the lower support surface projecting from the bracket module.

2. The shelf adjustment mechanism of claim 1, further comprising:

a biasing mechanism that biases the shelf bracket toward the securing position.

3. The shelf adjustment mechanism of claim 1, wherein the bracket module is adapted to be installed within a recess defined within an inner liner of the appliance.

4. The shelf adjustment mechanism of claim 1, wherein the shelf bracket is operable from the securing position to the recessed position by hand and without the use of tools.

5. The shelf adjustment mechanism of claim 1, further comprising:

a hinge extending from the bracket module to the shelf bracket, wherein the hinge defines the single pivot and a rotational axis of the shelf bracket, wherein rotation of the shelf bracket about the rotational axis defines the securing and recessed positions.

6. The shelf adjustment mechanism of claim 1, wherein the angled biasing surface is positioned proximate the upper support surface and tapers downward toward the lower support surface.

7. The shelf adjustment mechanism of claim 6, wherein each of the upper and lower support surfaces of the shelf bracket defines a continuous support surface.

8. The shelf adjustment mechanism of claim 1, wherein a lower angled biasing surface is positioned proximate the lower support surface.

9. The shelf adjustment mechanism of claim 8, wherein the angled biasing surface is an upper angled biasing surface, the upper angled biasing surface is configured to be biased toward the recessed position when a shelf in a substantially horizontal orientation is vertically operated in an upward direction from the position between the lower support surface and the upper support surface to a position above the upper support surface, wherein the lower support surface projects from the bracket module in each of the securing and recessed positions.

10. The shelf adjustment mechanism of claim 9, wherein the upper and lower support surfaces of the shelf bracket define upper and lower support positions of the shelf.

11. The shelf adjustment mechanism of claim 1, wherein the bracket module includes a single shelf bracket.

12. The shelf adjustment mechanism of claim 1, wherein the bracket module is configured to be disposed proximate a door dyke of an operable panel of the appliance.

13. The shelf adjustment mechanism of claim 12, wherein the operable panel is a rotationally operable door.

14. An appliance comprising:

a structural cabinet having an inner liner that defines a refrigerating compartment;

a shelf that is selectively disposed in a plurality of vertical positions within the refrigerating compartment; and a shelf adjustment mechanism coupled to the inner liner and defining the plurality of vertical positions of the shelf, the shelf adjustment mechanism comprising:

opposing shelf brackets that are rotationally biased about respective rotational axes a securing position that is configured to alternatively and selectively support the shelf in one of a lower shelf position and an upper shelf position of the plurality of vertical positions, wherein:

operation of the opposing shelf brackets from the securing position to a recessed position defines a clearance space above the lower shelf position that provides for vertical movement of the shelf within the refrigerating compartment, between the upper and lower shelf position, while a top surface of the shelf is maintained in a horizontal position;

operation of the opposing shelf brackets from the securing position to the recessed position is performed by upward vertical movement of the shelf from the lower shelf position to the upper shelf position;

each shelf bracket of the opposing shelf brackets includes upper and lower support members that each rotate about the respective rotational axes, and the upper and lower support members being substantially horizontal in the securing position and tilted in the recessed position.

15. The appliance of claim 14, further comprising:

an upper support surface that is cooperatively defined by the upper support members of the opposing shelf brackets, the upper support surface defining the upper shelf position; and a lower support surface that is cooperatively defined by the lower support members of the opposing shelf brackets, the lower support surface defining the lower shelf position.

16. The appliance of claim 15, wherein an angled biasing surface is positioned below each upper support surface of each of the opposing shelf brackets, wherein the upward vertical movement of the shelf from lower shelf position to the upper shelf position engages the shelf with at least one of the angled biasing surfaces and biases a corresponding one of the opposing shelf brackets to the recessed position.

17. The appliance of claim 14, wherein the shelf includes opposing edges, wherein each of the opposing edges is supported by one of the opposing shelf brackets, respectively.

18. A shelf adjustment mechanism for an appliance, the shelf adjustment mechanism comprising:

opposing shelf brackets rotationally coupled to an inner liner at respective rotational axes, wherein the opposing shelf brackets cooperate to define upper and lower support surfaces, wherein each shelf bracket of the opposing shelf brackets are biased toward a securing position where the upper and lower support surfaces are configured to be in a horizontal orientation relative to the inner liner;

opposing bracket modules that hingedly support the opposing shelf brackets at the respective rotational axes, respectively, wherein each shelf bracket is configured to selectively rotate within a respective bracket module of the opposing bracket modules between the securing position and a recessed position, wherein the lower support surfaces of the opposing shelf brackets rotate about the respective rotational axes and extend outward from the opposing bracket modules in each of the securing and recessed positions; and a shelf that is configured to selectively and alternatively rest on one of the upper and lower support surfaces in the securing position; wherein:

when the shelf is received on the lower support surface, slidable operation of the shelf in an upward direction biases the opposing shelf brackets to the recessed position;

the recessed position defines a clearance space above the lower support surfaces that provides for vertical movement of the shelf over the opposing shelf brackets;

when the shelf is slidably operated upward and above the opposing shelf backets in the recessed position, the opposing shelf brackets are biased back to the securing position to define the upper support surface.

19. The shelf adjustment mechanism of claim 18, wherein the slidable operation of the shelf in the upward direction engages the shelf with angled biasing surfaces of the opposing shelf brackets, wherein engagement of the shelf and a portion of the angled biasing surfaces biases the opposing shelf brackets to the recessed position, and wherein a biasing mechanism biases the opposing shelf brackets to the securing position.

* * * * *